US007393091B2

(12) United States Patent
Kumagai et al.

(10) Patent No.: US 7,393,091 B2
(45) Date of Patent: Jul. 1, 2008

(54) LIQUID-JETTING DEVICE

(75) Inventors: Toshio Kumagai, Nagano-ken (JP); Atsushi Kobayashi, Nagano-ken (JP); Hitotoshi Kimura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 246 days.

(21) Appl. No.: 10/541,035

(22) PCT Filed: May 7, 2004

(86) PCT No.: PCT/JP2004/006522

§ 371 (c)(1), (2), (4) Date: Jun. 28, 2005

(87) PCT Pub. No.: WO2004/098895

PCT Pub. Date: Nov. 18, 2004

(65) Prior Publication Data

US 2006/0132535 A1 Jun. 22, 2006

(30) Foreign Application Priority Data

May 9, 2003 (JP) ..... 2003-132343
Nov. 6, 2003 (JP) ..... 2003-377105

(51) Int. Cl.
*B41J 2/175* (2006.01)

(52) U.S. Cl. ..... 347/86; 347/49; 347/85; 347/87

(58) Field of Classification Search ..... 347/49, 347/85–87
See application file for complete search history.

(56) References Cited

U.S. PATENT DOCUMENTS

| | | | |
|---|---|---|---|
| 2003/0184623 | A1 | 10/2003 | Sasaki et al. |
| 2006/0132535 | A1 | 6/2006 | Kumagai et al. |

FOREIGN PATENT DOCUMENTS

| | | | | |
|---|---|---|---|---|
| JP | 59-184664 | | | 10/1984 |
| JP | 06-12044 | | | 2/1994 |
| JP | 7-89093 | A | | 4/1995 |
| JP | 07089093 | A | * | 4/1995 |
| JP | 8-169121 | A | | 7/1996 |
| JP | 08169121 | A | * | 7/1996 |
| JP | 08-272254 | | | 10/1996 |
| JP | 2000-343724 | | | 12/2000 |
| JP | 2002-200749 | A | | 7/2002 |
| JP | 2003-48315 | A | | 2/2003 |

* cited by examiner

*Primary Examiner*—Manish S. Shah
*Assistant Examiner*—Mark J Stevenosky, Jr.
(74) *Attorney, Agent, or Firm*—Sughrue Mion, PLLC

(57) ABSTRACT

An ink jet recording apparatus includes a slide member slidably supported at a cartridge holder and a lock claw member rotatably supported at the cartridge holder. The slide member slides along an insertion direction of an ink cartridge with respect to the cartridge holder between a first slide position and a second slide position. When the slide member is located at the second slide position, the lock claw member is located at a first rotation position. At this time, the ink cartridge is incapable of being removed from the cartridge holder. When the slide member moves to the first slide position from the second slide position, the lock claw member is located at the second rotation position. At this time, the ink cartridge is removable from the cartridge holder.

8 Claims, 18 Drawing Sheets

LIQUID-JETTING DEVICE

FIELD OF THE INVENTION

The present invention relates to a liquid ejection apparatus for ejecting liquid such as ink toward a target.

BACKGROUND OF THE INVENTION

A conventional ink jet recording apparatus as a liquid ejection apparatus includes a carriage, a recording head loaded on the carriage, and an ink cartridge as a liquid cartridge for storing ink to be supplied to the recording head. In the ink jet recording apparatus, printing is performed for a recording medium by ejecting ink from a nozzle provided at the recording head while relatively moving the carriage and the recording medium.

Ink jet recording apparatuses include a so-called off carriage type which is the type without an ink cartridge loaded on a carriage in order to reduce load on the carriage and to make the apparatus compact and thin. In the off carriage type ink jet recording apparatus, the ink cartridge usually includes an ink pack for housing ink and a case for housing the ink pack. The ink inside the ink pack is supplied to the recording head by supplying air pressurized by a pressure pump into a space between the ink pack and the case and crushing the ink pack, or by gravity by locating the ink cartridge above the carriage.

In the off carriage type ink jet recording apparatus, the ink cartridge is detachably attached to a cartridge holder provided at the recording apparatus. When the ink in the ink pack is used up, the old ink cartridge is removed from the cartridge holder, and a new ink cartridge is attached to the cartridge holder.

There are proposed various ink jet recording apparatuses which are improved to attach and detach the ink cartridge easily to and from the cartridge holder. For example, the ink jet recording apparatus disclosed in Japanese Laid-Open Patent Publication No. 2002-200749 includes a cover member which is opened when the ink cartridge is operated to be attached and detached, and an operation lever rotatably provided inside the cover member. The ink cartridge is attached and detached to and from the cartridge holder by rotating the operation lever.

In the recording apparatus disclosed in Japanese Laid-Open Patent Publication No. 2002-200749, fixation of the ink cartridge to the cartridge holder is mainly performed by means of the cover member. However, in the state in which the ink cartridge is attached to the cartridge holder, a gap occurs between the cover member and the ink cartridge. Therefore, the ink cartridge swings in the cartridge holder due to vibrations and drop during transportation and printing. As a result, there arises fear that an ink lead-in tube of the ink pack and an ink lead-out portion of the cartridge holder will become disconnected and an air lead-out tube of the ink cartridge and an air lead-in portion of the cartridge holder will become disconnected. Incomplete connection between the ink lead-in tube and the ink lead-out portion causes leakage of the ink, and incomplete connection between the air lead-out tube and the air lead-in portion makes it difficult to supply the pressurized air to the ink cartridge with high accuracy.

Therefore, in order to suppress swing of the ink cartridge in the cartridge holder, the cartridge holder and the ink cartridge are respectively provided with projections for positioning which are engaged with each other. However, when the ink cartridge is removed from the cartridge holder, it is not necessarily easy for users unaccustomed to replacement of the ink cartridges to pull the ink cartridge with strong force to release engagement of the projections.

SUMMARY OF THE INVENTION

An object of the present invention is to provide a liquid ejection apparatus capable of easily and reliably attaching and detaching a liquid cartridge to and from a cartridge holder.

In order to achieve the above described object, the present invention provides the following liquid ejection apparatus. The liquid ejection apparatus comprises a cartridge holder, a liquid cartridge which is detachably attached to the cartridge holder and stores liquid, a slide member and a rotating member. The liquid ejection apparatus ejects liquid in the liquid cartridge attached to the cartridge holder toward a target. The slide member is slidably supported at the cartridge holder. The slide member slides along an insertion direction of the liquid cartridge between a first position and a second position. The insertion direction is a direction in which the liquid cartridge is inserted into the cartridge holder when the liquid cartridge is attached to the cartridge holder. The rotating member is rotatably supported at the cartridge holder. Rotation of the rotating member is linked to sliding of the slide member. When the slide member moves to the second position from the first position, the rotating member displaces so as not to allow removal of the liquid cartridge from the cartridge holder, and when the slide member moves to the first position from the second position, the rotating member displaces to allow removal of the liquid cartridge from the cartridge holder.

The present invention also provides the following liquid ejection apparatus. The liquid ejection apparatus comprises a liquid ejection head for ejecting liquid toward a target, a liquid cartridge for storing the liquid, a liquid passage for connecting the liquid ejection head and the liquid cartridge, and a cartridge holder for housing the liquid cartridge. The cartridge holder comprises a slide member, a lock claw member and a rib. The slide member is slidable along an insertion direction of the liquid cartridge between a first slide position and a second slide position. The insertion direction is a direction in which the liquid cartridge is inserted into the cartridge holder when the liquid cartridge is attached to the cartridge holder. The lock claw member is supported at the slide member rotatably between a first rotation position and a second rotation position. The rib abuts the lock claw member. The rib makes the lock claw member to be located at the first rotation position when the slide member is located at the first position, and makes the lock claw member to be located at the second rotation position when the slide member is located at the second position. The liquid cartridge comprises an engaging portion which switches between a state in which the engaging portion is engaged with the lock claw member and a state in which the engaging portion is not engaged with the lock claw member, the engaging portion is not engaged with the lock claw member when the lock claw member is located at the first rotation position, and is engaged with the lock claw member when the lock claw member is located at the second rotation position.

The present invention provides the following liquid ejection apparatus. The liquid ejection apparatus comprises a liquid ejection head for ejecting liquid toward a target, a liquid cartridge for storing the liquid, a liquid passage for connecting the liquid ejection head and the liquid cartridge, and a cartridge holder for housing the liquid cartridge, a slide member and a rotating member. The slide member is slidably supported at the cartridge holder. The slide member slides along an insertion direction of the liquid cartridge between a first position and a second position. The insertion direction is a direction in which the liquid cartridge is inserted into the cartridge holder when the liquid cartridge is attached to the cartridge holder. The rotating member is rotatably supported at the cartridge holder. Rotation of the rotating member is linked to sliding of the slide member. When the slide member moves to the second position from the first position, the rotating member displaces So as to connect the liquid cartridge to the slide member, and when the slide member moves to the first position from the second position, the rotating member displaces to release connection of the liquid cartridge to the slide member.

The present invention also provides the following liquid ejection apparatus. The liquid ejection apparatus comprises a liquid ejection head for ejecting liquid toward a target, a liquid cartridge for storing the liquid, a liquid passage for connecting the liquid ejection head and the liquid cartridge, a cartridge holder for housing the liquid cartridge, and a slide member slidably supported at the cartridge holder. The slide member slides along an insertion direction of the liquid cartridge between a first slide position and a second slide position following attachment and detachment of the liquid cartridge to and from the cartridge holder. The insertion direction is a direction in which the liquid cartridge is inserted into the cartridge holder when the liquid cartridge is attached to on the cartridge holder. The liquid passage has a liquid supply needle that forms a connection portion to the liquid cartridge. The cartridge holder has an air lead-in tube connected to the liquid cartridge. The slide member has a part which guides the liquid supply needle and a part which guides a part of the air lead-in tube connected to the liquid cartridge.

DETAILED DESCRIPTION OF THE PREFERRED EMBODIMENTS

Hereinafter, a first embodiment of the present invention will be explained with reference to FIG. 1 to FIG. 11.

Figure 1:
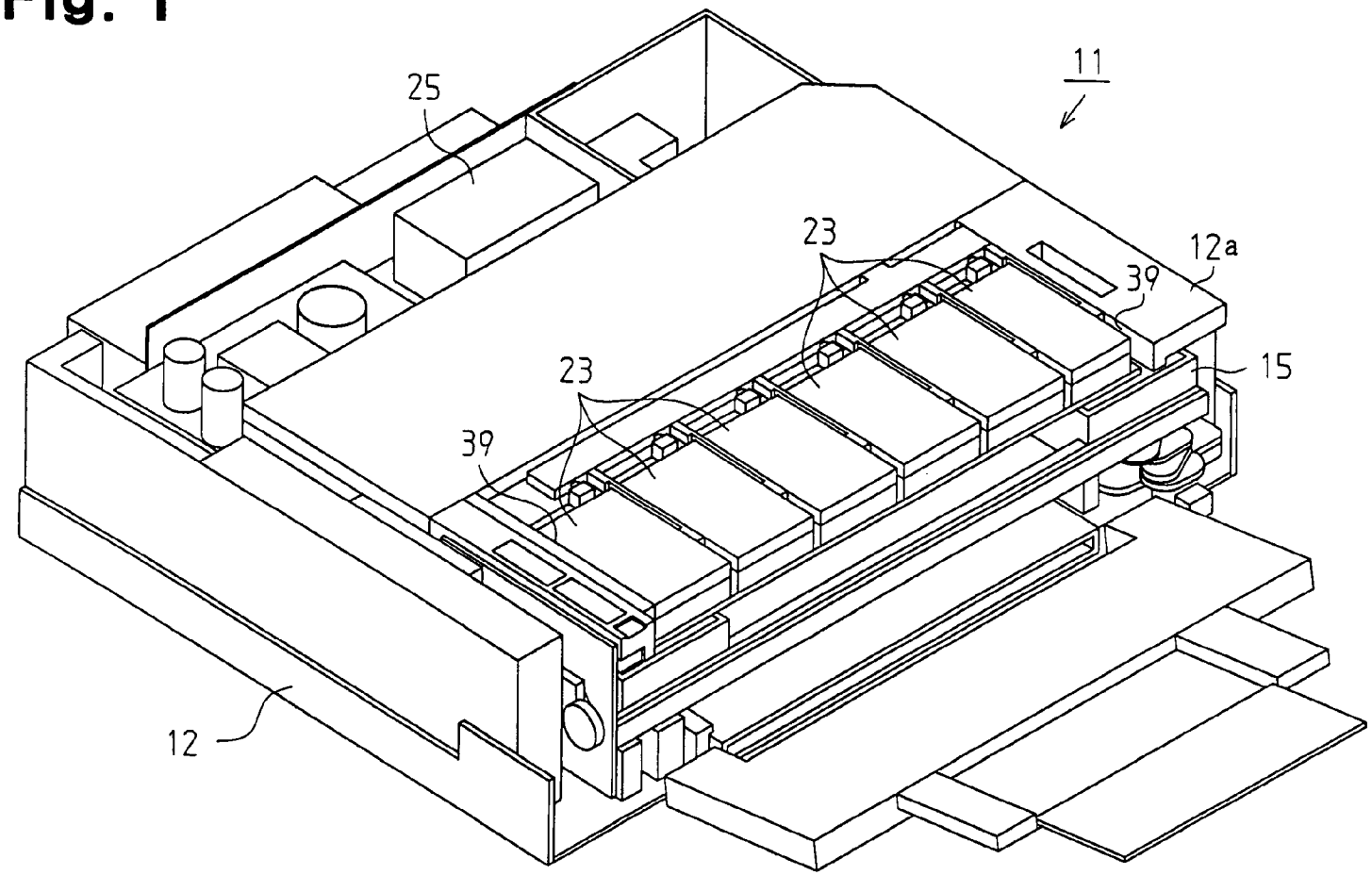
FIG. 1 is a perspective view showing an ink jet recording apparatus according to a first embodiment of the present invention.

A liquid ejection apparatus according to this embodiment is an ink jet recording apparatus 11 as shown in FIG. 1. As shown in FIG. 1, the recording apparatus 11 is housed in a body case 12. The body case 12 is a casing in a substantially rectangular parallelepiped shape, and a cartridge holder 12*a* is provided on a top surface of the body case 12.

Figure 2:
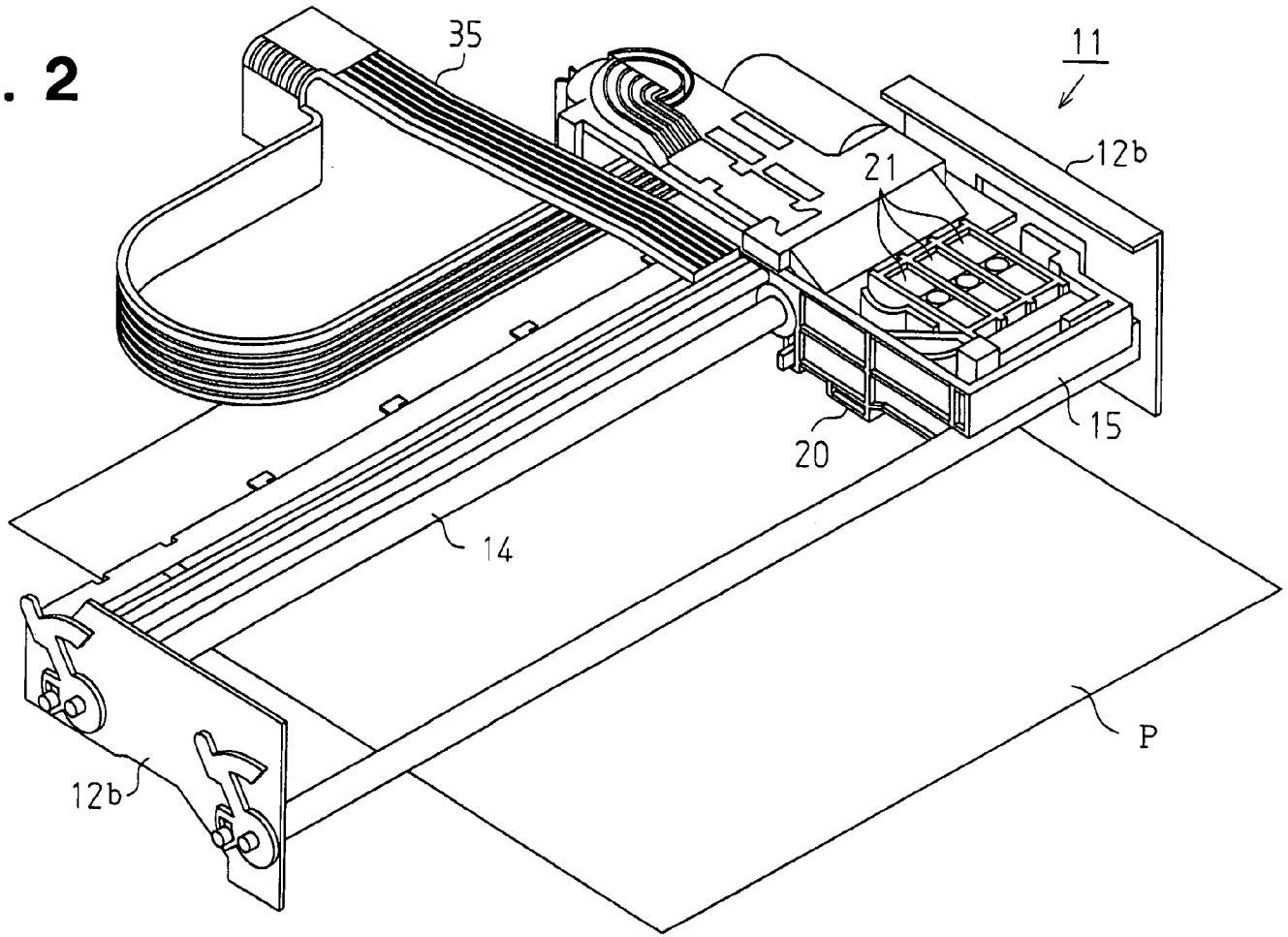
FIG. 2 is an exploded perspective view of the recording apparatus in FIG. 1.

A guide shaft 14, a carriage 15, a recording head 20 as a liquid ejection head and a valve unit 21, which are shown in FIG. 2, and an ink cartridge 23 as a liquid cartridge and a pressure pump 25, which are shown in FIG. 1, are disposed in the body case 12.

As shown in FIG. 2, the guide shaft 14 is formed into a rod-shape, and is laid between frames 12*b* in the body case 12. The carriage 15 is driven by and connected to a carriage motor (not shown) supported at the body case 12 via a timing belt (not shown). The carriage 15 is supported on the guide shaft 14 so as to reciprocally move on the guide shaft 14 along an axial direction of the guide shaft 14, following the drive of the carriage motor. Hereinafter, the movement direction of the carriage 15, namely, the axial direction of the guide shaft 14 is also called a main scanning direction.

The recording head 20 is provided at an undersurface of the carriage 15, and includes a plurality of nozzles (not shown), which eject ink as liquid. The valve unit 21, which is loaded on the carriage 15, temporarily stores ink taken in from the ink cartridge 23, and adjusts the stored ink at predetermined pressure and supplies the ink to the recording head 20.

The number of valve units 21 included by the recording apparatus 11 shown in FIG. 1 is three, and each valve unit 21 can adjust two kinds of ink at predetermined pressure and supply them individually to the recording head 20. Each of three valve units 21 is assigned with two of six kinds of ink of black, yellow, magenta, cyan, light magenta and light cyan.

A recording medium P as a target is fed below the recording head 20 along a direction (auxiliary scanning direction) perpendicular to the main scanning direction by feeding means (not shown). The recording medium P that is fed out is supported by a platen (not shown) provided between the frames 12*b*.

Figure 3:
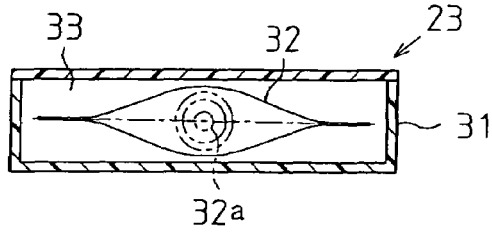
FIG. 3 is a sectional view of an ink cartridge in the recording apparatus in FIG. 1.

As shown in FIG. 1, the number of ink cartridges 23 included by the recording apparatus 11 is six, and each ink cartridge 23 stores one of six kinds of ink: black, yellow, magenta, cyan, light magenta and light cyan. The ink cartridge 23 is detachably attached to the cartridge holder 12*a*. As shown in FIG. 3, the ink cartridge 23 includes an ink case 31 as a liquid case and an ink pack 32 as a liquid housing part. The ink cartridge 23 shown in FIG. 3 is one of six ink cartridges 23, and the remaining five ink cartridges 23 have the same structures. The ink case 31 is formed of resin into a substantially rectangular parallelepiped shape. The ink pack 32 is formed by overlaying two flexible sheets on each other. Ink as liquid is sealed inside the ink pack 32.

The ink pack 32 has an ink discharge port 32*a*. A part of the ink discharge port 32*a* is exposed to the outside of the ink case 31, and the other part of the ink pack 32 is housed inside the ink case 31 in an airtight state. In the ink case 31, a gap 33 is provided between the ink case 31 and the ink pack 32.

The ink case 31 is provided with a communication hole, not shown, which allows the outside of the ink case 31 and the gap 33 to communicate with each other. When air is taken into the gap 33 via the communication hole, the ink pack 32 is crushed and ink inside the ink pack 32 is discharged through the ink discharge port. The ink discharge port 32*a* is connected to the above described valve unit 21 via an ink supply tube 35 shown in FIG. 2 as a liquid passage that is provided to correspond to each of the ink cartridges. The ink discharged from the ink pack 32 is supplied to the valve unit 21 via the ink supply tube 35.

As shown in FIG. 1, the pressure pump 25 is fixed to a rear part of the body case 12. The pressure pump 25 is connected to the above described communication hole of each of the ink cartridges 23 via an air supply tube (not shown). The pressure pump 25 sucks atmospheric air, pressurizes the sucked air, and introduces the air into the above described gap 33 of the ink cartridge 23 via an air supply tube.

The ink inside the ink pack 32 of the ink cartridge 23 is supplied to the valve unit 21 and as a result the ink pack 32 is crushed by the pressurized air supplied from the pressure pump 25. The ink supplied to the valve unit 21 is adjusted to predetermined pressure and then supplied to the recording head 20, and ejected toward the recording medium P, which is fed from the above described feeding means. When the ink is ejected from the recording head 20, the recording apparatus 11 moves the carriage 15 along the main scanning direction and at the same time, moves the recording medium P along the direction (auxiliary scanning direction) perpendicular to the main scanning direction, based on the data (image data) concerning printing to be performed on the recording medium P.

Next, the above described cartridge holder 12*a* will be explained in detail.

Figure 4:
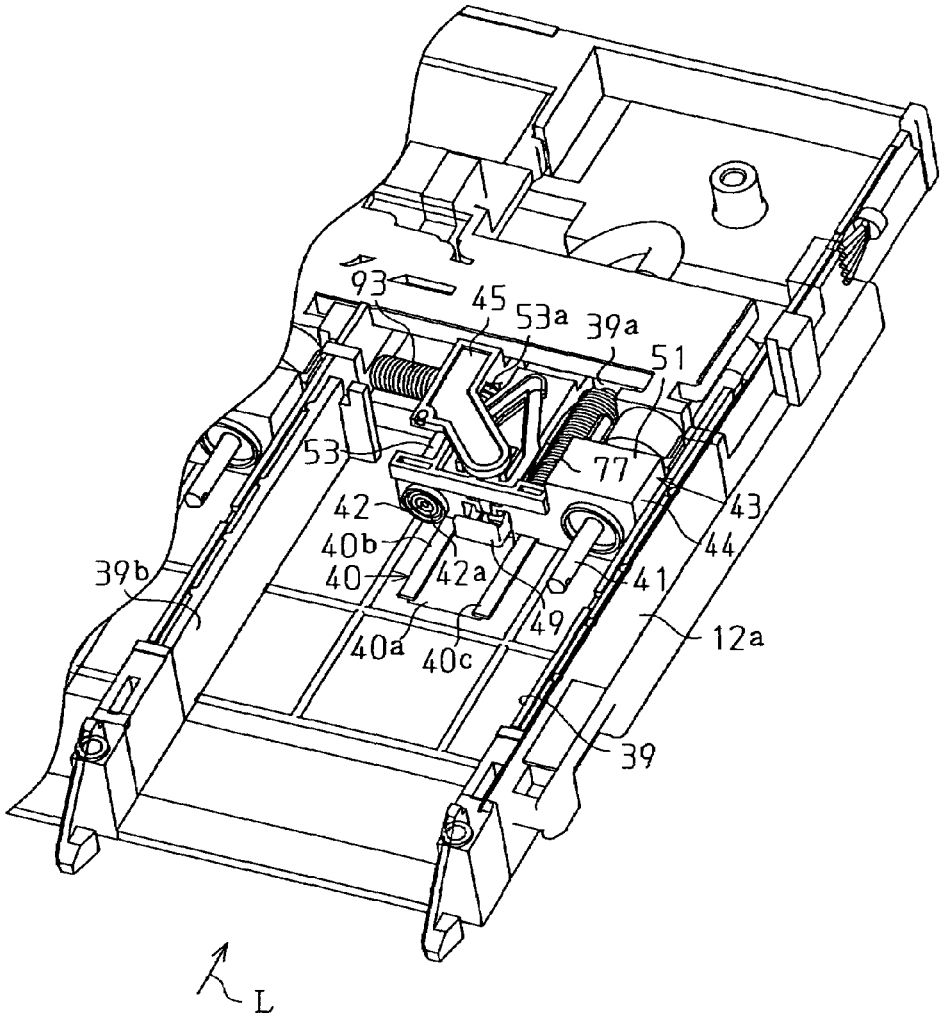
FIG. 4 is a partial perspective view of a cartridge holder in the recording apparatus in FIG. 1.

As shown in FIG. 1 and FIG. 4, the cartridge holder 12*a* includes six housing chambers 39 capable of housing the ink cartridges 23 placed in a horizontal state. When the ink cartridge 23 is housed in the housing chamber 39, the ink cartridge 23 is slid in the direction shown by the arrow L in FIG. 4. Namely, the arrow L direction is the insertion direction in which the ink cartridge 23 is inserted into the cartridge holder 12*a* when the ink cartridge 23 is attached to the cartridge holder 12*a*.

As shown in FIG. 4, a rail member 40 is provided in the vicinity of the center of a bottom surface of the housing chamber 39. The rail member 40 includes a plate part 40*a* in a substantially rectangular shape, and a pair of engaging pieces 40*b* and 40*c* provided at both sides of the plate part 40*a*. The plate part 40*a* is fixed in the state in which it closely contacts the bottom surface of the housing chamber 39. The engaging pieces 40*b* and 40*c* extend along the arrow L direction. A gap is provided between the engaging pieces 40*b* and 40*c*, and the bottom surface of the housing chamber 39.

An ink supply needle 41 as a liquid supply needle and an air introduction tube 42 as an air lead-in tube protrude from a wall surface 39*a* located at the innermost part of each of the housing chambers 39. The ink supply needle 41 is hollow, and is connected to the corresponding ink supply tube 35. When the ink cartridge 23 is correctly housed in the housing chamber 39, the ink supply needle 41 is inserted into the above described ink discharge port 32*a* of the ink cartridge 23 so that the inside of the ink pack 32 communicates with the inside of the ink supply tube 35.

The air introduction tube 42 has flexibility, and is connected to the above described air supply tube, which extends from the pressure pump. When the ink cartridge 23 is correctly housed in the housing chamber 39, the above described communication hole of the ink case 31 abuts the downstream end of the air introduction tube 42 so that the gap 33 of the ink cartridge 23 communicates with the inside of the air introduction tube 42. A seal member 42*a* is provided at the downstream end of the air introduction tube 42, and by this seal member 42*a*, air tightness at the connecting portion of the air introduction tube 42 and the ink cartridge 23 is secured.

Figure 5:
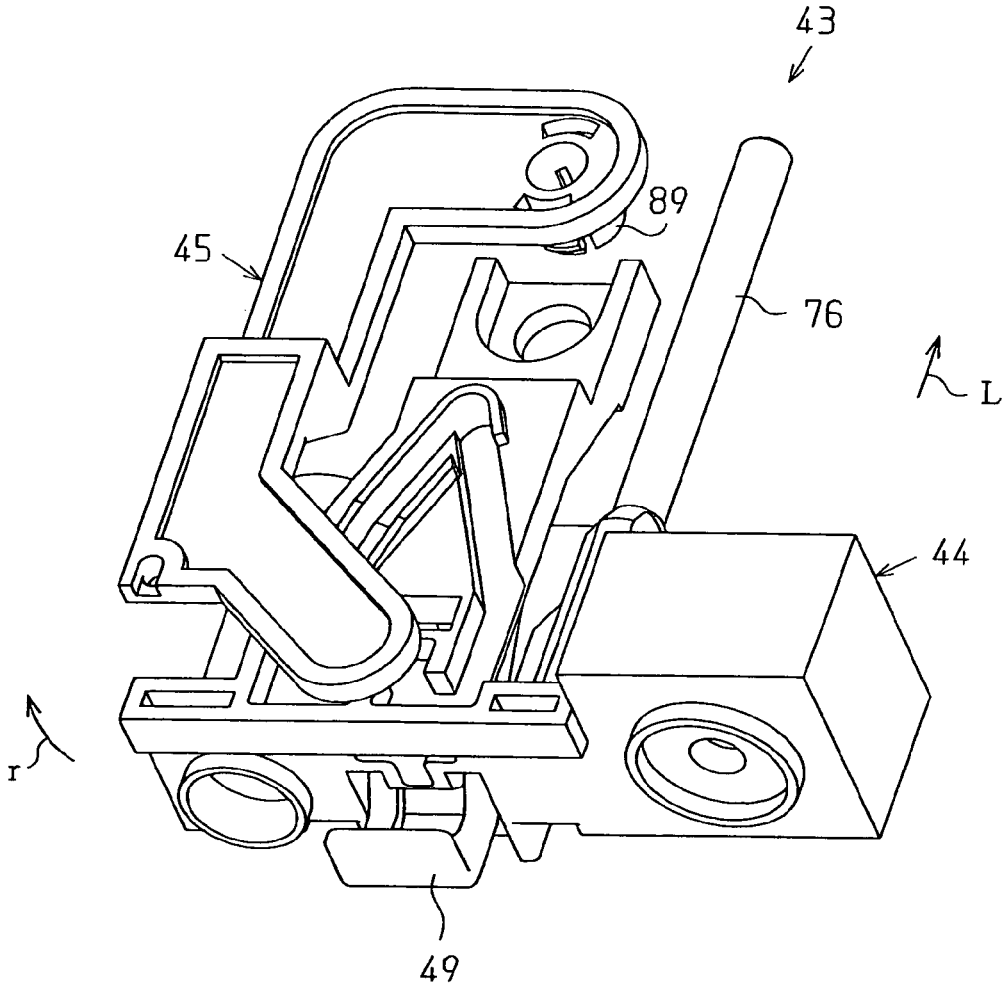
FIG. 5 is a perspective view of a connecting member in the recording apparatus in FIG. 1.

As shown in FIG. 4, a connecting member 43 as shown in FIG. 5 is disposed at the innermost part of the housing chamber 39. The connecting member 43 includes a slide member 44 and a latch claw member 45 forming fixing means.

Figure 6:
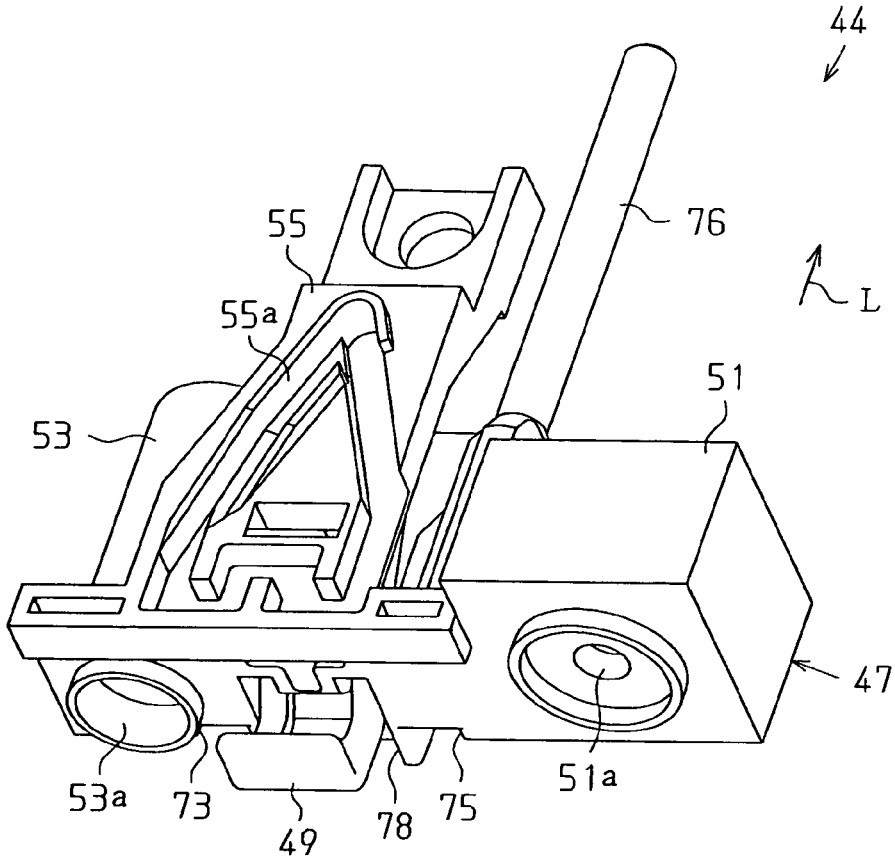
FIG. 6 is a perspective view of a slide member in the recording apparatus in FIG. 1.

As shown in FIG. 6, the slide member 44 includes a body part 47 and a lock claw member 49 as a rotating member. The body part 47 includes a casing part 51 as liquid absorbing means, a cylindrical part 53 as bending restraining means, and a latch groove part 55. The casing part 51 is the right side part of the slide member 44 in FIG. 6, and has a cavity therein. A needle through-hole 51*a*, which penetrates through the casing part 51 along the arrow L direction, is formed in the casing part 51. The above described ink supply needle 41 is movably inserted into the needle through-hole 51*a*. An absorbing material (not shown) constituted of Belleater or the like is housed in the casing part 51 to surround the needle through-hole 51*a*, and the absorbing material absorbs and retains ink leakage from the ink supply needle 41.

The cylindrical part 53 is the left side part of the slide member 44 in FIG. 6, and has a cylindrical shape. As shown in FIG. 4, the air introduction tube 42 projecting from the wall surface 39*a* of the above described housing chamber 39 is movably inserted through the cylindrical part 53. The air introduction tube 42 is guided along the arrow L direction by being inserted into the cylindrical part 53, and is prevented from bending. One end of a first coil spring 53*a* forming biasing means abuts the cylindrical part 53 as shown in FIG. 4. The other end of the first coil spring 53*a* abuts the wall surface 39*a* of the above described housing chamber 39. The first coil spring 53*a* biases the cylindrical part 53 in the direction of separation from the wall surface 39*a*.

Figure 7:
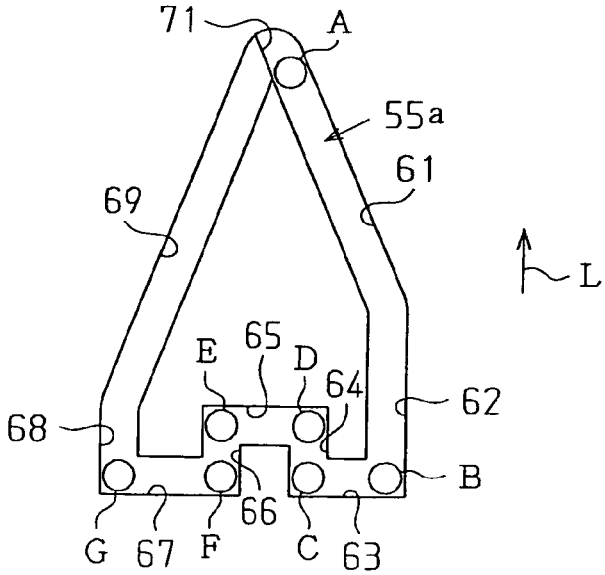
FIG. 7 is a schematic diagram of a latch groove in the recording apparatus in FIG. 1.

The latch groove part 55 is a part of the slide member 44, which is between the casing part 51 and the cylindrical part 53, and a latch groove 55*a* forming fixing means is formed on the top surface of the latch groove part 55. As shown in FIG. 7, the latch groove 55*a* includes nine linear groove portions that are first to ninth grooves 61 to 69. In this embodiment, the first groove 61 corresponds to a first groove portion, the fifth groove 65 corresponds to a second groove portion, the second to fourth grooves 62 to 64 correspond to a third groove portion, and the sixth to ninth grooves 66 to 69 correspond to a fourth groove portion.

The first groove 61 extends diagonally with respect to the arrow L direction. The terminal end of the first groove 61 is located nearer to the casing part 51 than the starting end of the first groove 61 (right side in FIG. 7) and at the front side (lower side in FIG. 7).

The second groove 62 extends along the arrow L direction. The starting end of the second groove 62 connects to the terminal end of the first groove 61. The terminal end of the second groove 62 is located at the front side (lower side in FIG. 7) from the starting end of the second groove 62.

The third groove 63 extends perpendicularly to the arrow L direction. The starting end of the third groove 63 connects to the terminal end of the second groove 62. The terminal end of the third groove 63 is located nearer to the cylindrical part 53 (left side in FIG. 7) than the starting end of the third groove 63.

The fourth groove 64 extends along the arrow L direction. The starting end of the fourth groove 64 connects to the terminal end of the third groove 63. The terminal end of the fourth groove 64 is located at the back side (upper side in FIG. 7) from the starting end of the fourth groove 64.

The fifth groove 65 extends perpendicularly to the arrow L direction. The starting end of the fifth groove 65 connects to the terminal end of the fourth groove 64. The terminal end of the fifth groove 65 is located nearer to (left side in FIG. 7) the cylindrical part 53 than the starting end of the fifth groove 65.

The sixth groove 66 extends along the arrow L direction. The starting end of the sixth groove 66 connects to the terminal end of the fifth groove 65. The terminal end of the sixth groove 66 is located at the front side (lower side in FIG. 7) from the starting end of the sixth groove 66.

The seventh groove 67 extends perpendicularly to the arrow L direction. The starting end of the seventh groove 67 connects to the terminal end of the sixth groove 66. The terminal end of the seventh groove 67 is located nearer to (left side in FIG. 7) the cylindrical part 53 from the starting end of the seventh groove 67.

The eighth groove 68 extends along the arrow L direction. The starting end of the eighth groove 68 connects to the terminal end of the seventh groove 67. The terminal end of the eighth groove 68 is located at the back side (upper side in FIG. 7) from the starting end of the eighth groove 68.

The ninth groove 69 extends diagonally with respect to the arrow L direction. The starting end of the ninth groove 69 connects to the terminal end of the eighth groove 68. The terminal end of the ninth groove 69 is located nearer to the casing part 51 (right side in FIG. 7) than the starting end of the ninth groove 69 and at the back side (upper side in FIG. 7), and connects to the starting end of the first groove 61.

The widths of the first to ninth grooves 61 to 69 are substantially the same as each other. The depths of the first to eighth grooves 61 to 68 are substantially the same as each other. As for the depth of the ninth groove 69, the depth of the ninth groove 69 at the starting end is substantially the same as the depths of the first to eighth grooves 61 to 68, and the depth of the ninth groove 69 becomes gradually shallower toward the terminal end from the starting end. Accordingly, a step 71 is formed in a border of the starting end of the first groove 61 and the terminal end of the ninth groove 69.

As shown in FIG. 6, two slide grooves 73 and 75 are provided at the undersurface of the body part 47 of the slide member 44. The slide grooves 73 and 75 extend along the arrow L direction. As shown in FIG. 4, the engaging pieces 40*b* and 40*c* of the above described rail member 40 are engaged with the slide grooves 73 and 75. As a result, the slide member 44 is slidable along the arrow L direction.

As shown in FIG. 6, the body part 47 includes a rod member 76, which projects in the arrow L direction. As shown in FIG. 4, a second coil spring 77 forming biasing means is fitted over the rod member 76. One end of the second coil spring 77 abuts the body part 47, and the other end of the second coil spring 77 abuts the wall surface 39*a* at the innermost part of the housing chamber 39. The body part 47 is biased to separate from the wall surface 39*a* of the housing chamber 39 (see FIG. 4) by the second coil spring 77.

Figure 8:
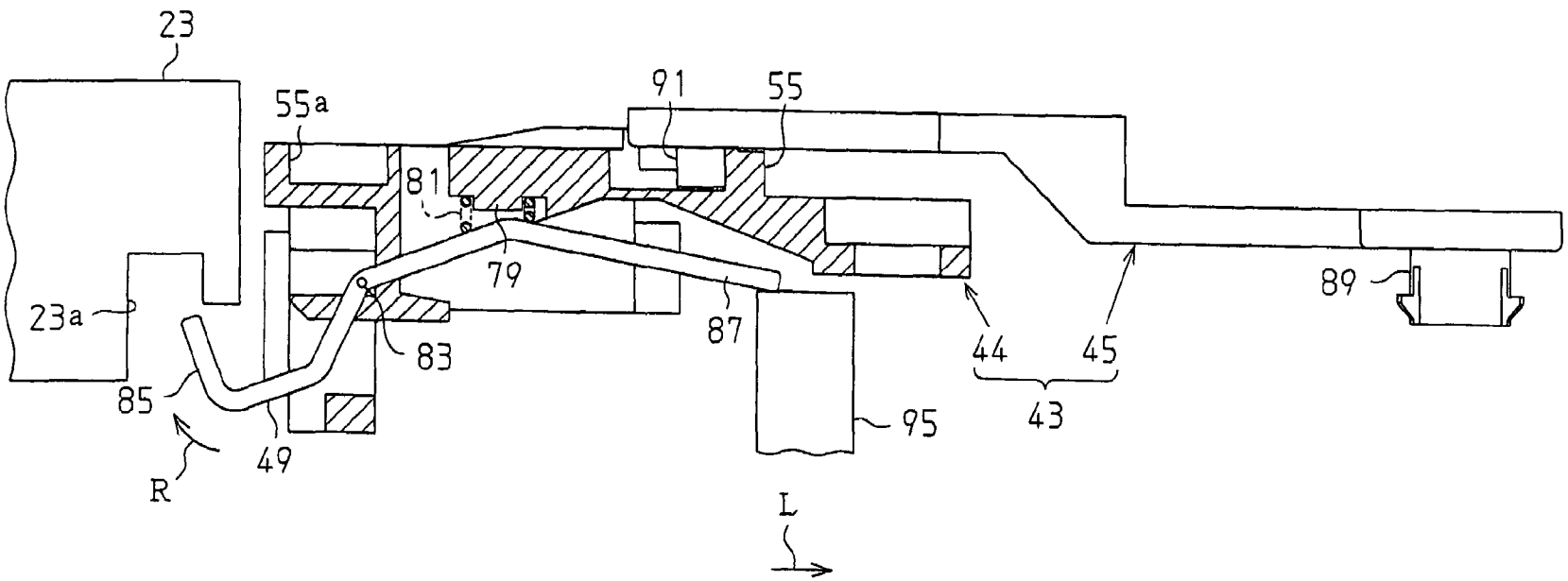
FIG. 8 is a sectional view of the connecting member in the recording apparatus in FIG. 1.

As shown in FIG. 6, a recessed portion 78, which is at a location sandwiched by the above described slide grooves 73 and 75, is provided at the undersurface of the body part 47. Further, as shown in FIG. 8, in the body part 47, a columnar portion 79 is formed to project downward from the undersurface of the above described latch groove part 55. The upper end of a third coil spring 81 is fitted over the columnar portion 79.

The lock claw member 49 has a shape which is made by bending a planar member a plurality of times, and includes a support shaft 83 formed integrally at its center. The lock claw member 49 is located in the above described recessed portion 78, and the support shaft 83 of the lock claw member 49 has both ends rotatably mounted to the body part 47. Accordingly, the lock claw member 49 is capable of normal rotation, which is the rotation along the arrow R direction shown in FIG. 8 around the support shaft 83, and reverse rotation, which is rotation along the reverse direction to the arrow R direction.

The lock claw member 49 includes one side portion 85 near to the ink cartridge 23 and the other side portion 87 near to the wall surface 39*a* (see FIG. 4) which are located with the support shaft 83 therebetween. The one side portion 85 has a sectional shape along the arrow L direction substantially formed in the shape of the Japanese letter "コ" (substantially U-shaped) and opening upward. The other side portion 87 has the sectional shape along the arrow L direction substantially formed in a V-shape open toward the lower side. The top surface of the other side portion 87 abuts the lower end of the above described third coil spring 81. Therefore, the lock claw member 49 is biased to rotate in the reverse rotation direction by the third coil spring 81.

An engaging recessed portion 23*a* as an engaging portion is formed at the undersurface of a part of the ink cartridge 23, which is located at the innermost part of the housing chamber 39 when the ink cartridge 23 is housed in the housing chamber 39. When the one side portion 85 of the lock claw member 49 is engaged in the engaging recessed portion 23*a*, movement of the ink cartridge 23 in the arrow L direction is restrained.

As shown in FIG. 5, the latch claw member 45 is formed into a plate shape substantially in the shape of the Japanese letter "コ" (substantially U-shaped). A cylindrical shaft portion 89 projecting downward is formed at one end of the latch claw member 45. The cylindrical shaft portion 89 is rotatably fitted into a fitting hole (not shown) provided in the above described housing chamber 39 (see FIG. 4). Accordingly, the latch claw member 45 is mounted at the above described housing chamber 39 so as to be capable of normal rotation, which is the rotation in the arrow r direction with the cylindrical shaft portion 89 as the center of rotation and reverse rotation, which is rotation in the reverse direction to the arrow r direction.

As shown in FIG. 8, a columnar claw member 91 projecting downward is provided at the other end of the latch claw member 45. The claw member 91 engages in the latch groove 55*a* of the above described slide member 44, and is movable in the latch groove 55*a*. The claw member 91 moves within the range of the latch groove 55*a*, and thereby, the position of the above described slide member 44 in the arrow L direction is determined.

Figure 9:
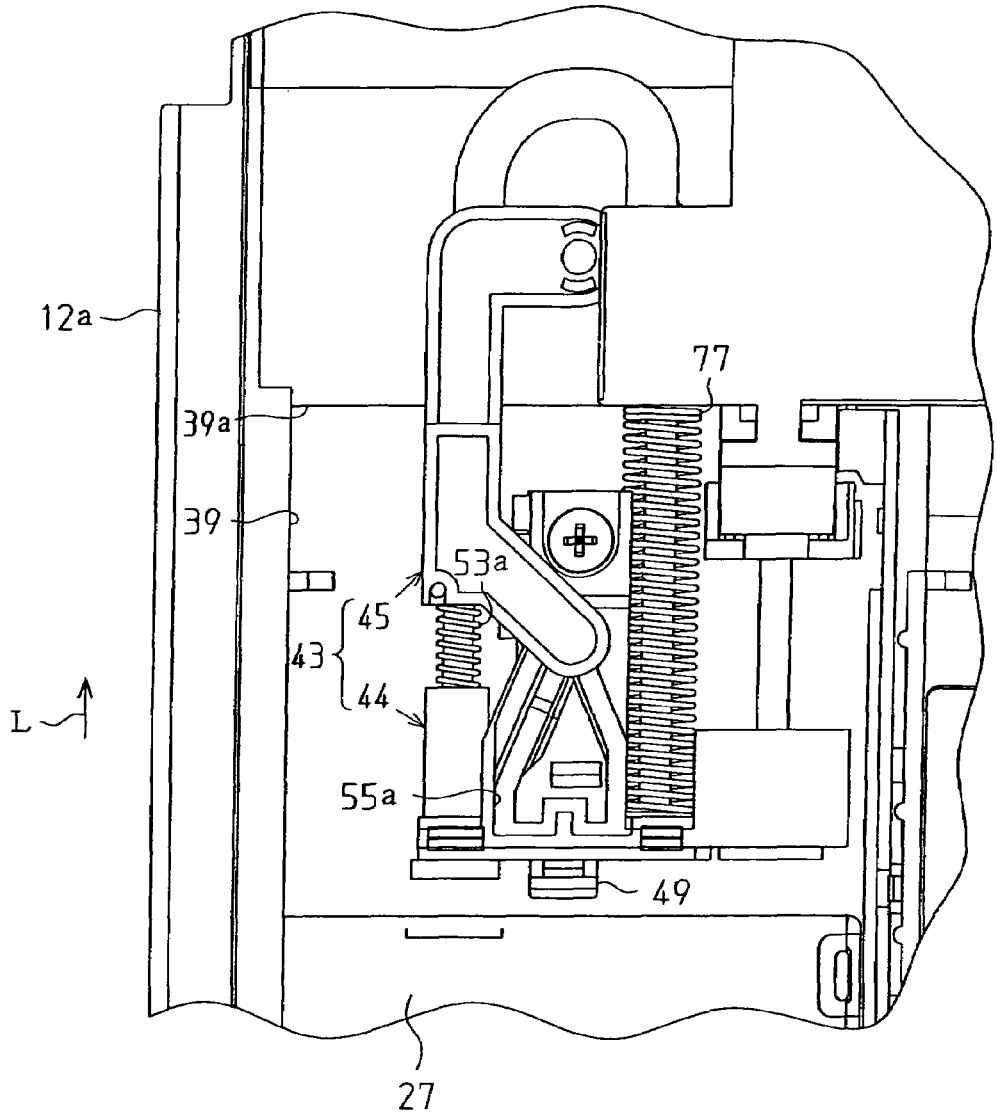
FIG. 9 is a partial plan view of a cartridge holder in the recording apparatus in FIG. 1.

More specifically, when the claw member 91 engages in the latch groove 55*a* at the starting end of the first groove 61, namely, in the engaging position A shown in FIG. 7, the slide member 44 is located to separate from the wall surface 39*a* of the housing chamber 39 as shown in FIG. 8 and FIG. 9. In this embodiment, the position of the slide member 44 at this time shall be called an extraction allowing position as a first position (first slide position).

Figure 10:
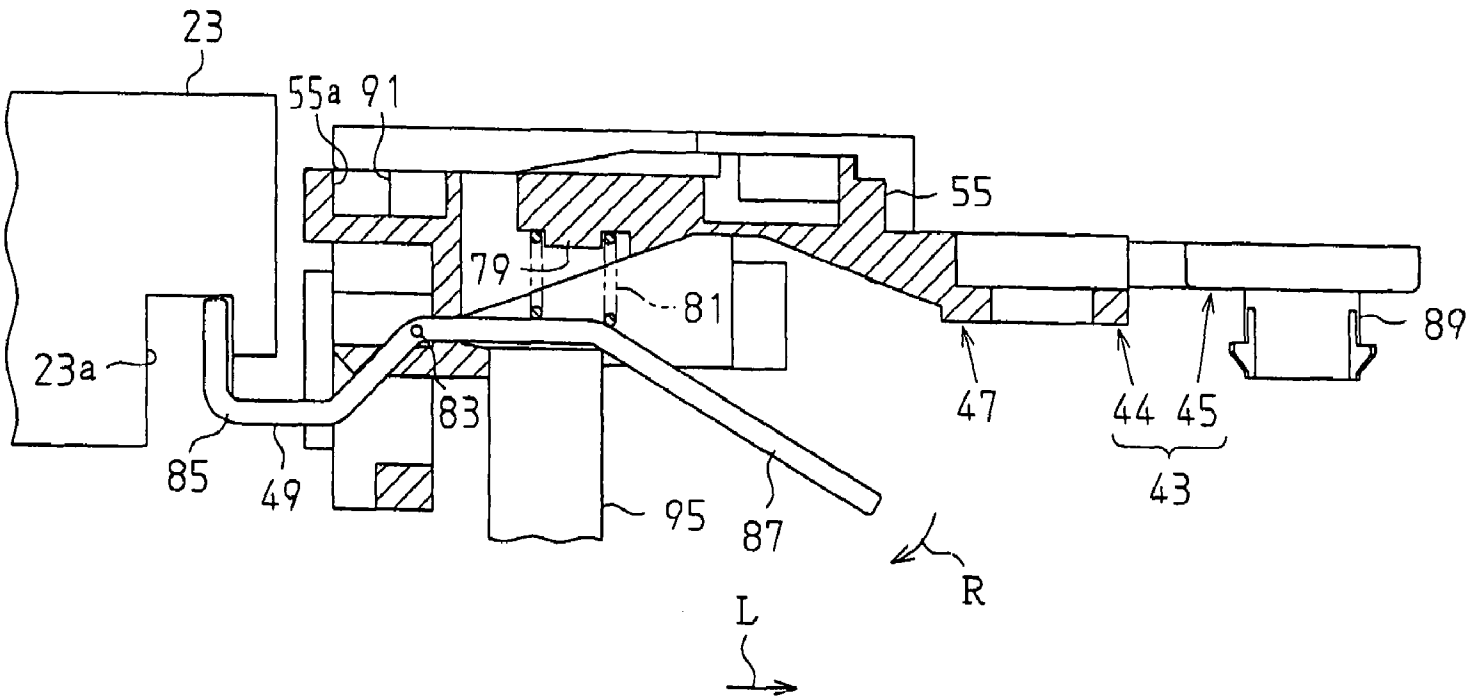
FIG. 10 is a view explaining an operation of the connecting member in the recording apparatus in FIG. 1.
Figure 11:
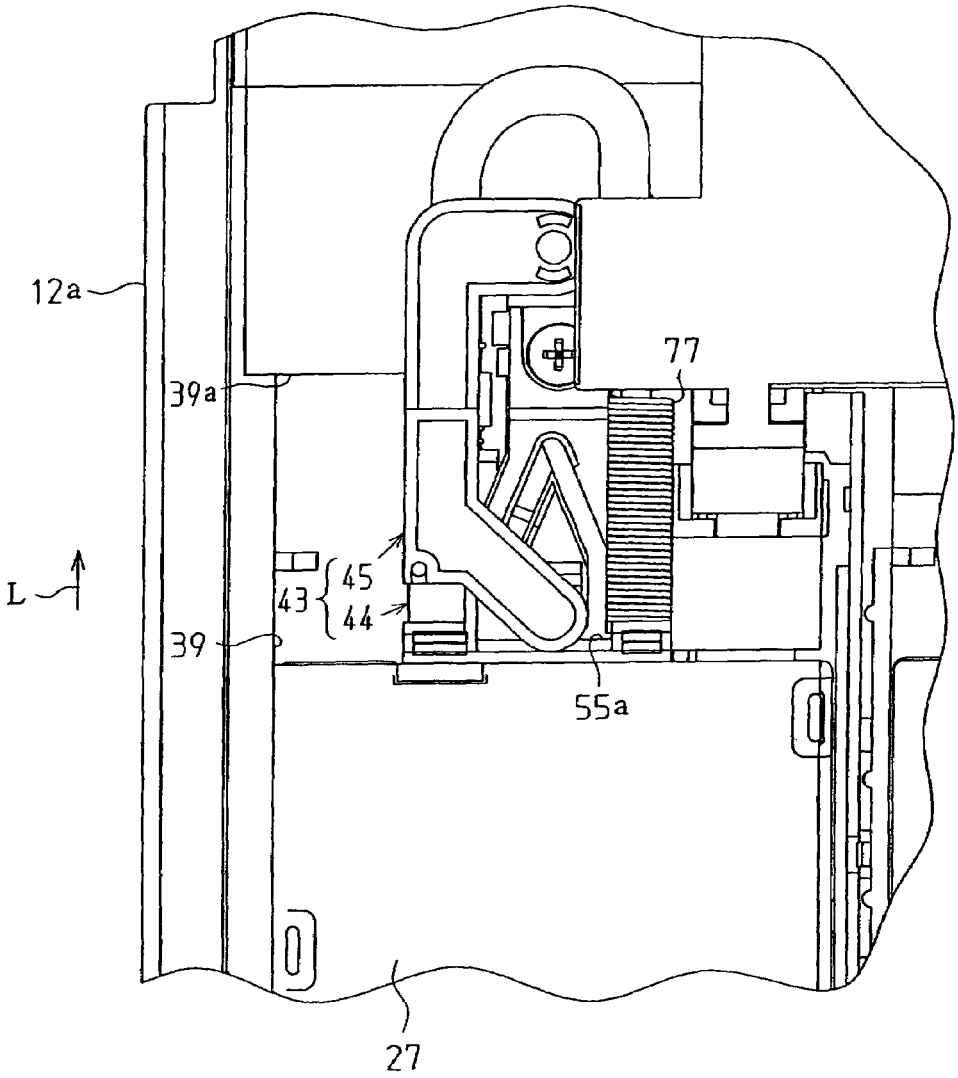
FIG. 11 is a view explaining an operation of the connecting member in the recording apparatus in FIG. 1.

When the claw member 91 engages in the latch groove 55*a* at the terminal end of the fifth groove 65, namely, the engaging position E shown in FIG. 7 on the other hand, the slide member 44 is located close to the wall surface 39*a* of the housing chamber 39 as shown in FIG. 10 and FIG. 11. In this embodiment, the position of the slide member 44 at this time shall be called a mounting position as a second position (second slide position).

As shown in FIG. 4, one end of a fourth coil spring 93 is fixed to the latch claw member 45. The other end of the fourth coil spring 93 is fixed to the left side surface 39*b* of the above described housing chamber 39. Accordingly, the latch claw member 45 is biased to rotate in the normal rotation direction by the fourth coil spring 93.

As shown in FIG. 8, a rib 95 is provided to project upward from the bottom surface of the above described housing chamber 39 (see FIG. 4). As shown in FIG. 8, when the slide member 44 is located at the extraction allowing position, the rib 95 abuts an end portion at the side of the wall surface 39*a* (see FIG. 4) of the other side portion 87 of the above described lock claw member 49. Accordingly, when the slide member 44 is located at the extraction allowing position, the lock claw member 49 is displaced in the reverse rotation direction, and the one side portion 85 of the lock claw member 49 is located at a lower position. In this state, the one side portion 85 of the lock claw member 49 is located at the position where it is incapable of engaging in the engaging recessed portion 23*a* of the above described ink cartridge 23. The position of the lock claw member 49 at this time corresponds to the first rotation position.

When the slide member 44 is located at the mounting position as shown in FIG. 10, the rib 95 abuts the portion near to the above described support shaft 83 in the other side portion 87. Accordingly, when the slide member 44 is located at the mounting position, the lock claw member 49 is displaced in the normal rotation direction, and the one side portion of the lock claw member 49 is located at an upper position. In this state, the one side portion 85 of the lock claw member 49 is located at the position where it is engageable in the engaging recessed portion 23*a* of the above described ink cartridge 23. The position of the lock claw member 49 at this time corresponds to the second rotation position.

Next, concerning the ink jet recording apparatus 11 constructed as above, operation when the ink cartridge 23 is attached and detached will be explained.

In the state in which the ink cartridge 23 is not housed in the housing chamber 39 of the ink jet recording apparatus 11, the slide member 44 is located at the extraction allowing position as shown in FIG. 8 and FIG. 9. In this state, the user slides a new ink cartridge 23 into the housing chamber 39 of the cartridge holder 12*a* along the arrow L direction, and thereby, the ink cartridge 23 abuts the slide member 44. At this time, the one side portion 85 of the lock claw member 49 is located at the lower position, and the one side portion 85 of the lock claw member 49 is in the state incapable of engaging in the engaging recessed portion 23*a* of the ink cartridge 23.

When the user further presses the ink cartridge 23 in the arrow L direction, the slide member 44 is moved in the arrow L direction against the biasing force of the first coil spring 53*a* and the second coil spring 77. Then, the claw member 91 of the latch claw member 45 moves along the first groove 61 and the second groove 62 of the latch groove 55*a* to be located at the terminal end of the second groove 62, namely, the engaging position B, as shown in FIG. 7.

When the claw member 91 is located at the engaging position B, the latch claw member 45 is normally rotated by the biasing force of the fourth coil spring 93, and the claw member 91 moves along the third groove 63 of the latch groove 55*a*. As a result, the latch claw member 45 is located at the terminal end of the third groove 63, namely, the engaging position C.

When the user stops pressing the ink cartridge 23 in this state, the slide member 44 is moved in the direction of separation from the wall surface 39*a* (see FIG. 4) by the biasing force of the second coil spring 77 and the fourth coil spring 93. As a result, the latch claw member 45 moves along the fourth groove 64, and is located at the terminal end of the fourth groove 64, namely, the engaging position D. Then, the latch claw member 45 is normally rotated by the biasing force of the fourth coil spring 93, and the claw member 91 moves along the fifth groove 65 of the latch groove 55*a*. As a result, the claw member 91 is located at the terminal end of the fifth groove 65, namely, the engaging position E.

When the claw member 91 is located at the engaging position E, the position of the slide member 44 is located at the mounting position as shown in FIG. 10 and FIG. 11. Accordingly, the lock claw member 49 is displaced in the normal rotation direction, and is in the state in which it is engaged in the engaging recessed portion 23*a* of the ink cartridge 23. As a result, the movement of the ink cartridge 23 in the arrow L direction is restrained by strong engagement between the lock claw member 49 and the engaging recessed portion 23*a*.

Namely, when the ink cartridge 23 is housed in the cartridge holder 12*a*, the user only has to stop pressing after sliding the ink cartridge 23 into the housing chamber 39 and pressing it to the back once. By doing so, the ink cartridge 23 is easily housed in the cartridge holder 12*a*. In the state in which the ink cartridge 23 is housed in the housing chamber 39, the movement of the ink cartridge 23 in the arrow L direction is restrained by engagement between the lock claw member 49 and the engaging recessed portion 23*a*. Therefore, even if vibration and drop occur to the ink jet recording apparatus 11, ink leakage and air leakage hardly occur.

As described above, the air introduction tube 42 (see FIG. 4) is supported by the cylindrical part 53 of the slide member 44 in the state in which bending is prevented. Accordingly, when the ink cartridge 23 is housed in the cartridge holder 12*a*, the air introduction tube 42 (see FIG. 4) and the communication hole of the ink cartridge 23 can be connected with high accuracy.

When the ink cartridge 23 housed in the housing chamber 39 is removed, the user presses the ink cartridge 23 in the arrow L direction. Then, the slide member 44 moves in the arrow L direction against the biasing forces of the first coil spring 53*a* and the second coil spring 77. Then, the claw member 91 of the latch claw member 45 moves along the sixth groove 66 of the latch groove 55*a* as shown in FIG. 7, and is located at the terminal end of the sixth groove 66, namely, the engaging position F.

When the claw member 91 is located at the engaging position F, the latch claw member 45 is normally rotated by the biasing force of the fourth coil spring 93, and the claw member 91 moves along the seventh groove 67 of the latch groove 55*a*. As a result, the latch claw member 45 is located at the terminal end of the seventh groove 67, namely, the engaging position G.

When the user stops pressing the ink cartridge 23 in this state, the slide member 44 is moved in the direction of separation from the wall surface 39*a* (see FIG. 4) by the biasing forces of the second coil spring 77 and the fourth coil spring 93. As a result, the latch claw member 45 moves along the eighth and ninth grooves 68 and 69, and moves to the terminal end of the ninth groove 69. Then, the latch claw member 45 passes over the step 71 and drops, and is located at the starting end of the first groove 61, namely, the engaging position A.

As a result, the slide member 44 is located at the extraction allowing position as shown in FIG. 8 and FIG. 9. Accordingly, the lock claw member 49 is displaced in the reverse rotation direction, and is brought into the state in which it is not engaged in the engaging recessed portion 23*a* of the cartridge 23. In this state, the user need only grasp the ink cartridge 23 and slightly pull it, and thereby, the user can easily extract the cartridge 23 from the cartridge holder 12*a*.

The first embodiment has the following advantages.

(1) In the above described embodiment, the slide member 44 is displaced to the mounting position from the extraction allowing position by inserting the ink cartridge 23 into the housing chamber 39 of the cartridge holder 12*a* and pressing the slide member 44. As a result, the ink cartridge 23 is switched into the state in which it is fixed to be incapable of being extracted from the state in which it is easily extractable from the housing chamber 39. By moving the ink cartridge 23 in the extracting direction from the housing chamber 39, the position of the slide member 44 is displaced to the extraction allowing position from the mounting position. As a result, the ink cartridge 23 is switched into the state in which it is easily extractable from the state in which it is fixed to be incapable of being extracted from the housing chamber 39.

Accordingly, when the slide member 44 is located at the extraction allowing position, the user can attach and detach the ink cartridge 23 with small force by extracting and inserting the ink cartridge 23 from and into the housing chamber 39. When the slide member 44 is located at the mounting position, the movement of the ink cartridge 23 in the arrow L direction is strongly restrained by engagement of the lock claw member 49 and the engaging recessed portion 23*a*. Accordingly, ink is effectively prevented from leaking out of the connecting portions of the ink cartridge 23 and the ink supply needle 41 due to vibration, drop and the like in the ink jet recording apparatus 11.

(2) In the above described embodiment, the slide member 44 is biased in the direction of separation from the wall surface 39*a* of the housing chamber 39 by the first coil spring 53*a* and the second coil spring 77. The slide member 44 is fixed at the mounting position by engagement of the latch groove 55*a* and the latch claw member 45.

Accordingly, when the slide member 44 is moved to the mounting position from the extraction allowing position, it is suitable to slide the slide member 44 against the biasing forces of the first and second coil springs 53*a* and 77 and locate the slide member 44 at the mounting position. The slide member 44 when located at the mounting position is kept at the mounting position by the latch groove 55*a* and the latch claw member 45. On the other hand, when the slide member 44 is moved to the extraction allowing position from the mounting position, the slide member 44 naturally moves to the extraction allowing position by the biasing forces of the first and second coil springs 53*a* and 77 by releasing engagement of the latch groove 55*a* and the latch claw member 45.

Namely, when the slide member 44 is displaced to the extraction allowing position or the mounting position, the slide member 44 only has to be pressed in the insertion direction of the ink cartridge 23. Accordingly, switching of the position of the slide member 44 is extremely easy.

(3) In the above described embodiment, the slide member 44 is provided with the latch groove 55*a*, and the position of the slide member 44 is determined by the engagement position of the latch groove 55*a* and the claw member 91 of the latch claw member 45. Accordingly, movement accuracy of the slide member 44 is enhanced, and movement of the slide member 44 is stabilized.

(4) In the above described embodiment, when the slide member 44 is located at the mounting position, the claw member 91 is located at the engaging position E of the latch groove 55*a*. When the claw member 91 is located at the engaging position E, the slide member 44 is moved in the insertion direction of the ink cartridge 23, and thereby, the claw member is moved to the engaging position A where the slide member 44 is located at the extraction allowing position from the engaging position E.

Accordingly, in order to displace the position of the slide member 44 between the extraction allowing position and the mounting position, the slide member 44 only has to be pressed in the insertion direction of the ink cartridge 23. Accordingly, switching of the position of the slide member 44 is extremely easy.

(5) In the above described embodiment, the ink cartridge 23 is provided with the engaging recessed portion 23*a*, and this engaging recessed portion 23*a* is engaged with the lock claw member 49, whereby the ink cartridge 23 is fixed at the mounting position. Accordingly, with just the minimal design change of only providing the engaging recessed portion 23*a*, the specification for the existing ink cartridge can be changed to a specification that is engageable with the lock claw member 49.

(6) In the above described embodiment, the slide member 44 is provided with the casing part 51 having the needle through-hole 51*a*, and an absorbing material is housed inside the casing part 51. Accordingly, ink leakage out of the ink supply needle 41 when the ink cartridge 23 is extracted from the housing chamber 39 is absorbed by the absorbing material inside the casing part 51. Accordingly, the inside of the housing chamber 39 is kept clean.

(7) In the above described embodiment, the slide member 44 is provided with the cylindrical part 53, and by the cylindrical part 53, and bending of the air introduction tube 42 is prevented. Accordingly, when the ink cartridge 23 is housed in the housing chamber 39, the air introduction tube 42 is positioned by the cylindrical part 53 integrated with the slide member 44 with the movement of the slide member 44. Accordingly, connection accuracy of the communication hole of the ink cartridge 23 and the air introduction tube 42 is enhanced.

The above described embodiment may be changed as follows.

In the above described embodiment, the first and second coil springs 53*a* and 77 are used as biasing means, but only any one of the first and second coil springs 53*a* and 77 may be used. Alternatively, three or more coil springs may be used, or both of the first and second coil springs 53*a* and 77 may be omitted. However, when both of the first and second coil springs 53*a* and 77 are omitted, the user needs to grasp the ink cartridge 23 with fingers or the like and extract it. The biasing means may not be a coil spring, but may be an elastic member such as rubber.

In the above described embodiment, the fixing means for keeping the slide member 44 in the mounting position is formed by the latch groove 55*a* and the latch claw member 45. This fixing means may be changed to the other fixing means only if it retains the slide member 44 in the mounting position and is switchable to allow movement to the extraction allowing position from the mounting position in accordance with necessity.

In the above described embodiment, the ink cartridge 23 is provided with the engaging recessed portion 23*a* as the engaging portion, and the shape of the lock claw member 49 is in a shape engageable with this engaging recessed portion 23*a*. However, the shapes for the engaging portion of the ink cartridge 23 and the lock claw member 49 may be correspond to other shapes only if the ink cartridge 23 and the lock claw member 49 are disengaged and engaged with each other when the slide member 44 is located at the extraction allowing position and the mounting position.

The casing part 51 of the slide member 44 may be omitted.

The cylindrical part 53 of the slide member 44 may be omitted.

In the above described embodiment, the ink cartridge 23 as the liquid cartridge is formed by the ink pack 32 as the liquid housing portion, and the ink case 31 as the liquid case, but the liquid housing portion and the liquid case are not limited to this. For example, the liquid housing portion and a gap may be formed by partitioning the inside of the ink case 31 by a film or the like.

In the above described embodiment, the ink jet recording apparatus 11 transfers the ink inside the ink pack 32 into the recording head 20 by introducing air into the gap 33 between the ink pack 32 and the ink case 31. Instead of this, the position of the ink pack 32 is located above the recording head 20, and thereby, the ink inside the ink pack 32 may be transferred to the recording head 20 by gravity. In this case, it is not necessary to provide the cylindrical part 53 at the slide member 44.

The present invention may be embodied in an ink jet recording apparatus other than the recording apparatus 11 in FIG. 1, for example, in printing apparatuses such as a fax and a copier. Alternatively, the present invention may be embodied in a liquid ejection apparatus which ejects liquid other than ink. The liquid ejection apparatus, which ejects liquid other than ink, may be a liquid ejection apparatus that ejects liquid, such as an electrode material and a coloring material, which are used for manufacturing a liquid crystal display, an EL display and a surface emitting display, a liquid ejection apparatus for ejecting biological organic matter used for manufacturing biochips, or a specimen ejection apparatus as a precision pipette.

A second embodiment of the present invention will be explained with reference to FIG. 12 to FIG. 23 hereinafter.

Figure 12:
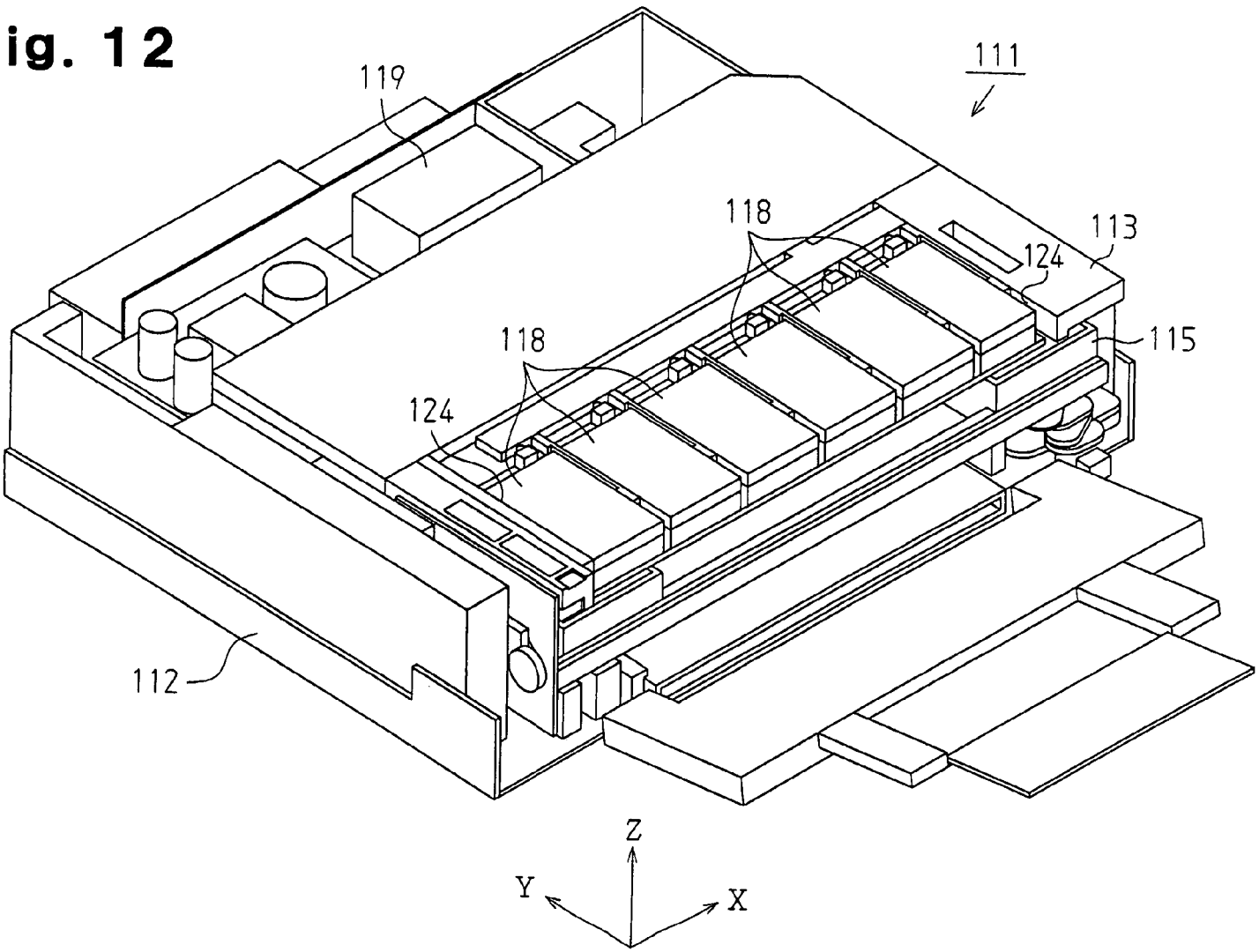
FIG. 12 is a perspective view showing an ink jet recording apparatus according to a second embodiment of the present invention.

A liquid ejection apparatus according to this embodiment is an ink jet recording apparatus 111 (printer 111) shown in FIG. 12. As shown in FIG. 12, the recording apparatus 111 is housed in a body case 112. The body case 112 is a casing in a substantially rectangular parallelepiped shape, and a cartridge holder 113 is provided on a top surface of the body case 112.

Figure 13:
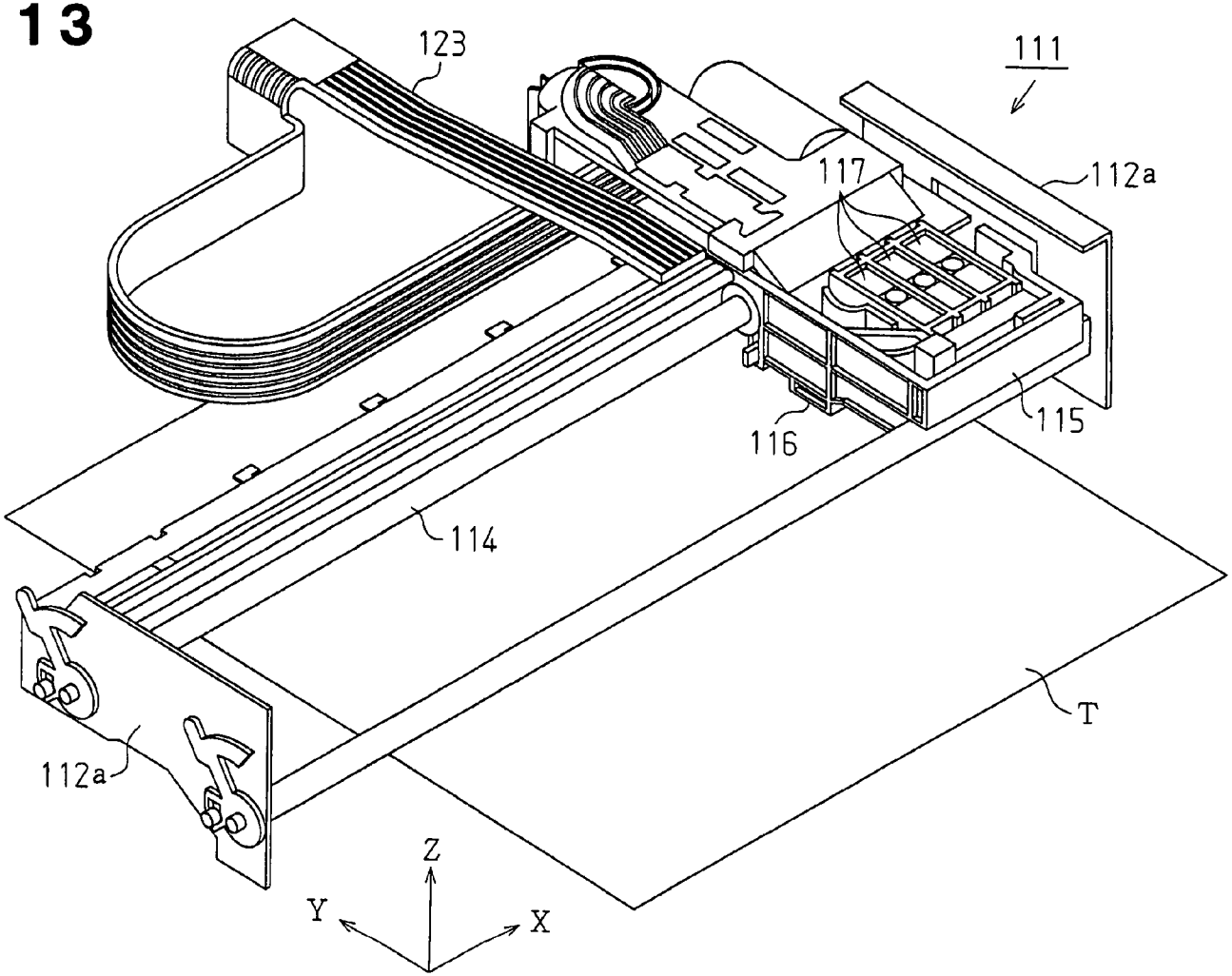
FIG. 13 is an exploded perspective view of an essential part of the recording apparatus in FIG. 12.

A guide shaft 114, a carriage 115, a recording head 116 as a liquid ejection head and a valve unit 117, which are shown in FIG. 13, and an ink cartridge 118 as a liquid cartridge and a pressure pump 119, which are shown in FIG. 12, are disposed in the body case 112.

As shown in FIG. 13, the guide shaft 114 is formed into a rod-shape, and is laid between frames 112*a* in the body case 112. The carriage 115 is driven by and connected to a carriage motor (not shown) supported at the body case 112 via a timing belt (not shown). The carriage 115 is supported on the guide shaft 114 so as to reciprocally move on the guide shaft 114 along an axial direction of the guide shaft 114, following the drive of the carriage motor. Hereinafter, the movement direction of the carriage 115, namely, the axial direction of the guide shaft 114 is also called a main scanning direction.

The recording head 116 is provided at an undersurface of the carriage 115, and includes a plurality of nozzles (not shown), which eject ink as liquid. The valve unit 117, which is loaded on the carriage 115, temporarily stores ink taken in from the ink cartridge 118, and adjusts the stored ink at predetermined pressure and supplies the ink to the recording head 116.

The number of valve units 117 included by the recording apparatus 111 shown in FIG. 12 is three, and each valve unit 117 can adjust two kinds of ink at predetermined pressure and supply them individually to the recording head 116. Each of three valve units 117 is assigned with two of six kinds of ink: black, yellow, magenta, cyan, light magenta and light cyan.

A recording medium T as a target is fed out below the recording head 116 along a direction (auxiliary scanning direction) perpendicular to the main scanning direction by feeding means (not shown). The recording medium T that is fed out is supported by a platen (not shown) provided between the frames 112*a*.

Figure 14:
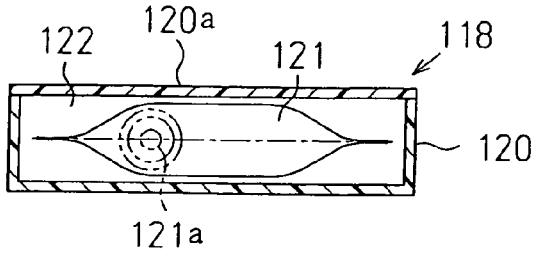
FIG. 14 is a sectional view of an ink cartridge in the recording apparatus in FIG. 12.

As shown in FIG. 12, the number of ink cartridges 118 included by the recording apparatus 111 is six, and each ink cartridge 118 stores one of six kinds of ink: black, yellow, magenta, cyan, light magenta and light cyan. The ink cartridge 118 is detachably attached to the above described cartridge holder 113. As shown in FIG. 14, the ink cartridge 118 includes an ink case 120 as a liquid case and an ink pack 121 as a liquid housing part. The ink cartridge 118 shown in FIG. 14 is one of six ink cartridges 118, and the remaining five ink cartridges 118 have the same structures. The ink case 120 is formed of resin into a substantially rectangular parallelepiped shape. The ink pack 121 is formed by overlaying two flexible sheets on each other. Ink is sealed inside the ink pack 121.

The ink pack 121 includes an ink discharge port 121*a*. A part of the ink discharge port 121*a* is exposed to the outside of the ink case 120, and the other part of the ink pack 121 is housed inside the ink case 120 in an airtight state. In the ink case 120, a gap 122 is provided between the ink case 120 and the ink pack 121.

The ink case 120 is provided with a communication hole, not shown, which allows the outside of the ink case 120 and the gap 122 to communicate with each other. When air is taken into the gap 122 via this communication hole, the ink pack 121 is crushed and ink inside the ink pack 121 is discharged through the ink discharge port 121*a*. The ink discharge port 121*a* is connected to the above described valve unit 117 via an ink supply tube 123 shown in FIG. 13 as a liquid passage that is provided to correspond to each of the ink cartridges 118. The ink discharged from the ink pack 121 is supplied to the valve unit 117 via the ink supply tube 123.

Figure 19:
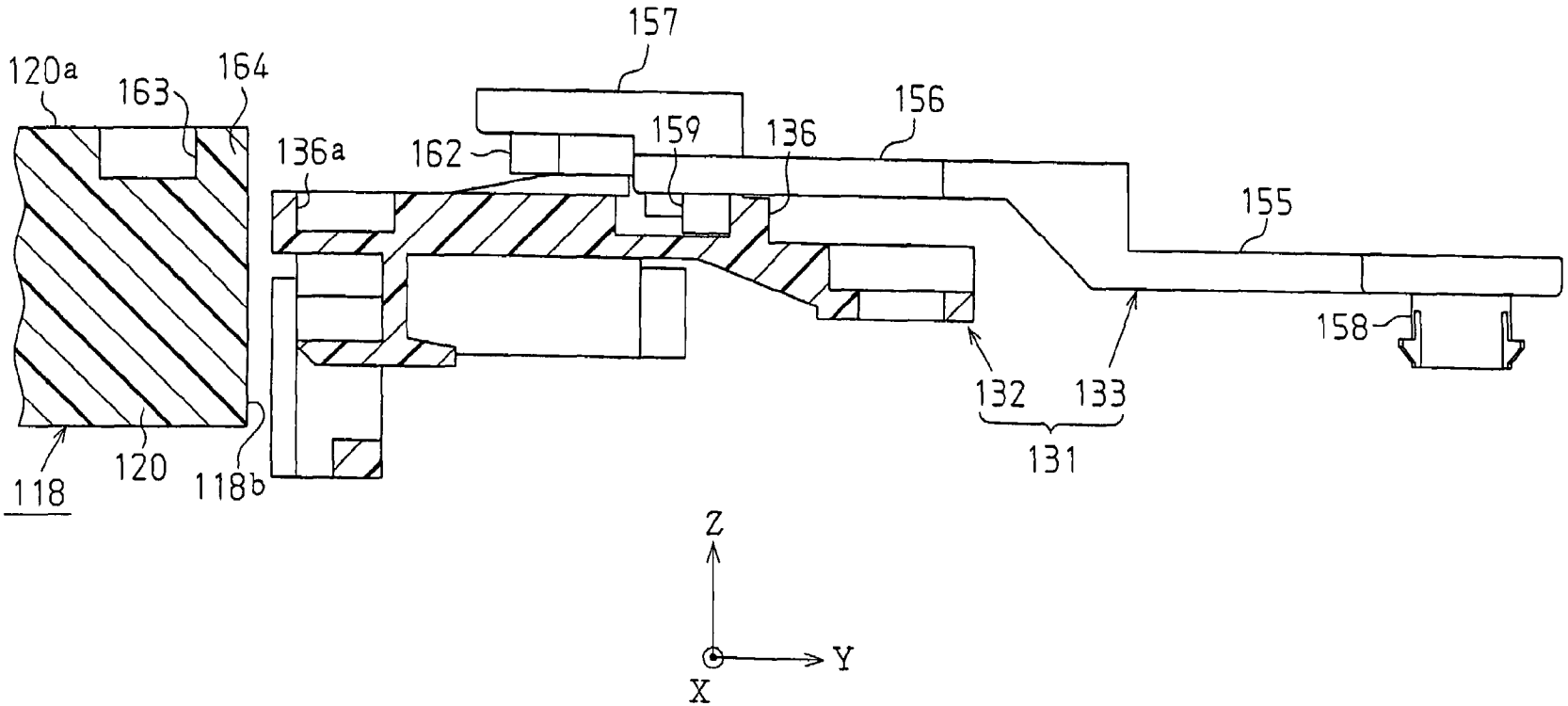
FIG. 19 is a sectional view of the connecting member in the recording apparatus in FIG. 12.
Figure 20:
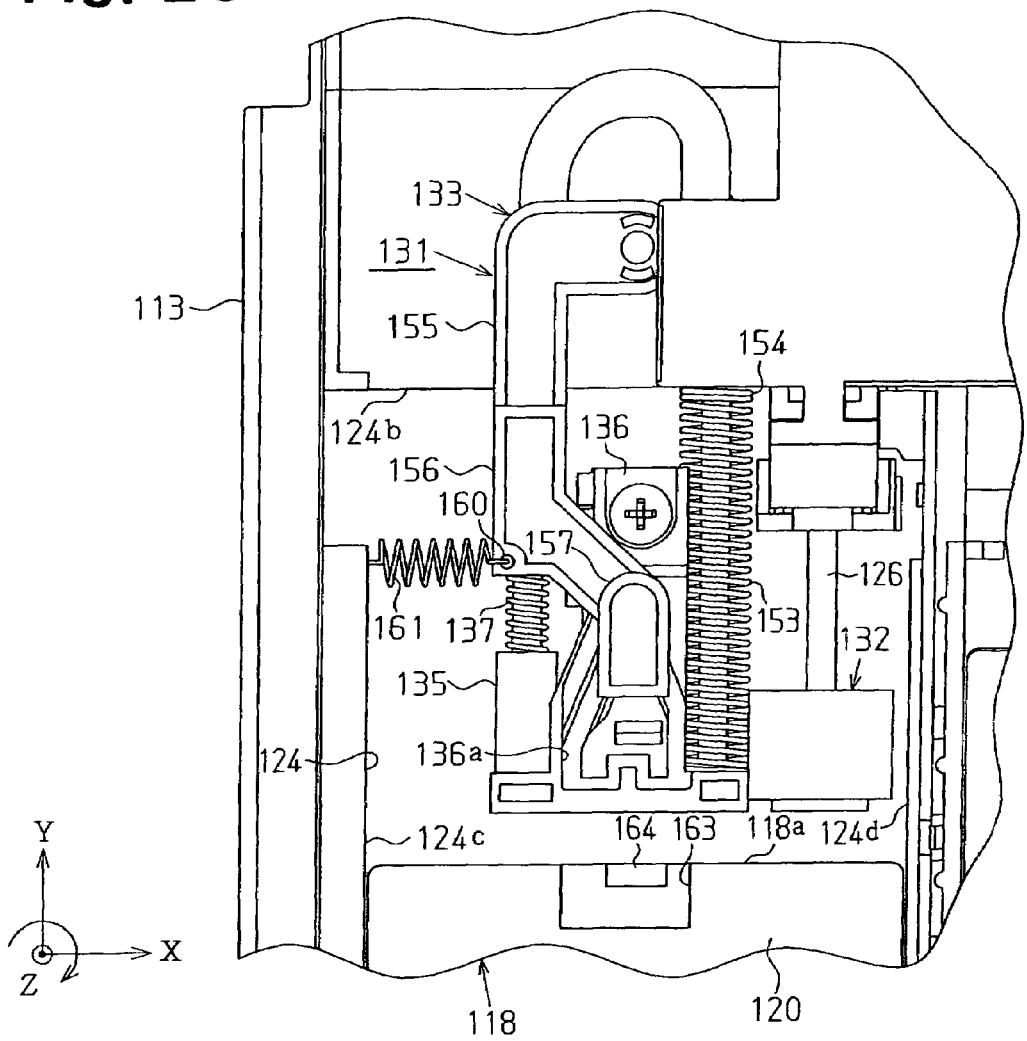
FIG. 20 is a partial plan view of the cartridge holder in the recording apparatus in FIG. 12.
Figure 21:
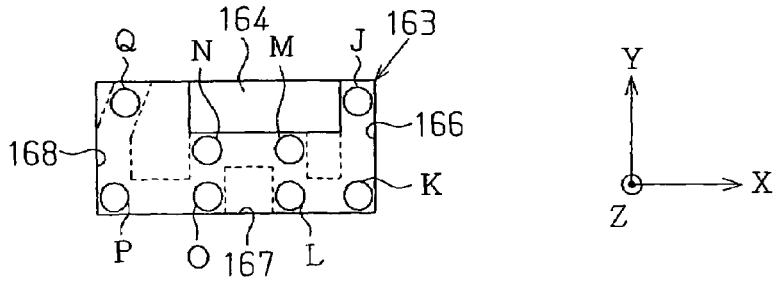
FIG. 21 is a schematic diagram of a groove in the recording apparatus in FIG. 12.

As shown in FIG. 19 and FIG. 20, a groove 163 having both end portions, which are opened at one side of the ink case 120, is formed on an upper surface 120*a* of the ink case 120. The groove 163 includes three linear groove portions, which are a first guide groove 166, a second guide groove 167 and a third guide groove 168 as shown in FIG. 21. A portion of the upper surface 120*a* of the ink case 120 surrounded by the groove 163 constructs a locking portion 164.

As shown in FIG. 12, the pressure pump 119 is fixed to a rear part of the body case 112. The pressure pump 119 is connected to the above described communication hole of each of the ink cartridges 118 via an air supply tube, not shown. The pressure pump 119 sucks atmospheric air, pressurizes the sucked air, and introduces the air into the above described gap 122 of the ink cartridge 118 via an air supply tube.

The ink inside the ink pack 121 of the ink cartridge 118 is supplied to the valve unit 117 and as a result the ink pack 121 is crushed by the pressurized air supplied from the pressure pump 119. The ink supplied to the valve unit 117 is adjusted to predetermined pressure and then supplied to the recording head 116, and ejected toward the recording medium T, which is fed from the above described feeding means. When the ink is ejected from the recording head 116, the recording apparatus 111 moves the carriage 115 along the main scanning direction and at the same time, moves the recording medium T along the direction (auxiliary scanning direction) perpendicular to the main scanning direction, based on the data (image data) concerning printing to be performed on the recording medium T.

Next, the above described cartridge holder 113 will be explained in detail.

Figure 15:
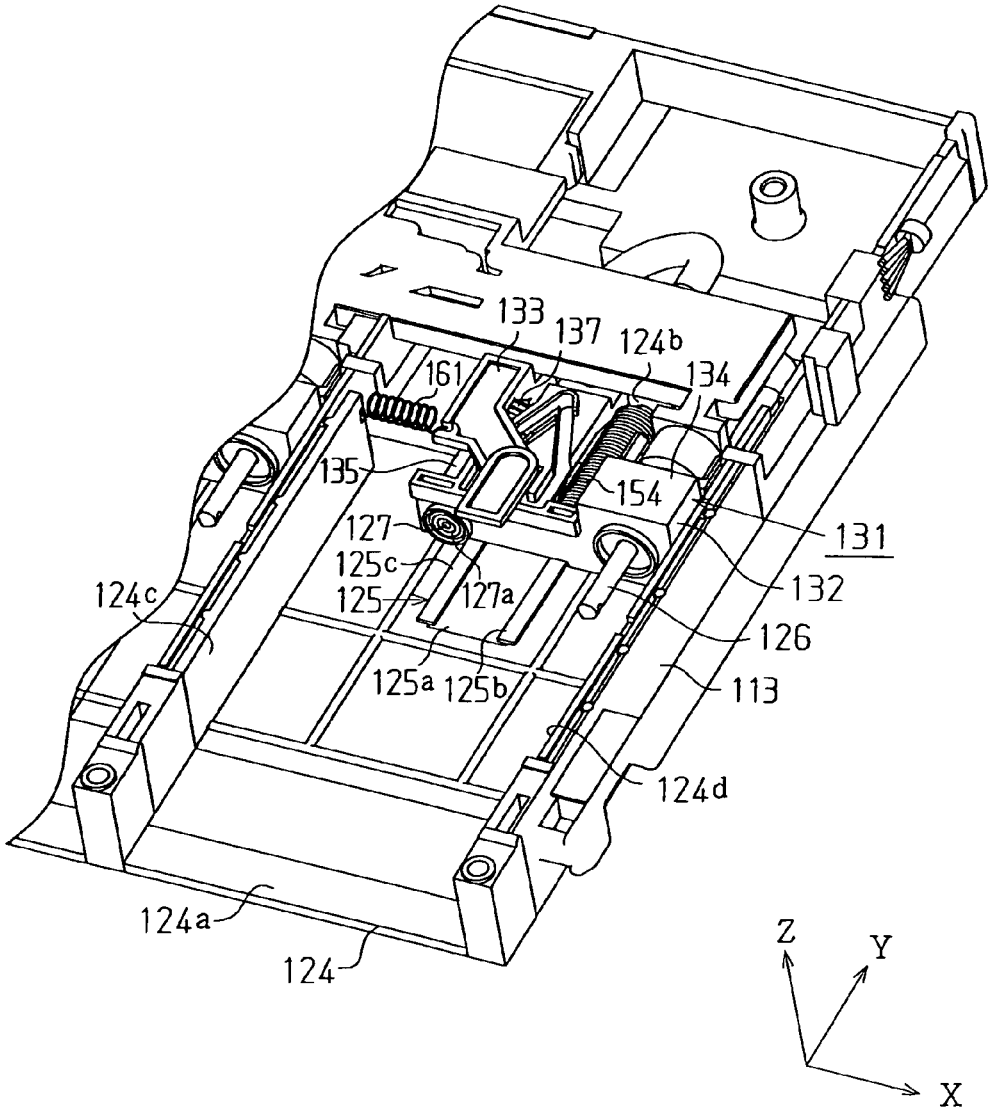
FIG. 15 is a partially perspective view of a cartridge holder in the recording apparatus in FIG. 12.

As shown in FIG. 12, the cartridge holder 113 is disposed above the carriage 115. The cartridge holder 113 includes six housing chambers 124 capable of housing the ink cartridges 118 placed in a horizontal state. As shown in FIG. 15, each of the housing chambers 124 is defined by a bottom surface 124*a*, and three side surfaces 124*b*, 124*c* and 124*d*. When the ink cartridge 118 is housed in the housing chamber 124, the ink cartridge 118 is slid in the direction shown by the arrow Y in FIG. 15. Namely, the direction of the arrow Y is the insertion direction in which the ink cartridge is inserted into the cartridge holder 113 when the ink cartridge 118 is attached to the cartridge holder 113. The movement in the X-axis direction (see FIG. 15) of the ink cartridge 118 at the time of sliding is restrained by the side surface 124*c* and the side surface 124*d* of the housing chamber 124.

As shown in FIG. 15, a rail member 125 is provided in the vicinity of the center of the bottom surface 124*a* of the housing chamber 124. The rail member 125 includes a plate part 125*a* in a substantially rectangular shape, and a pair of engaging pieces 125*b* and 125*c* provided at both sides of the plate part 125*a*. The plate part 125*a* is fixed in the state in which it closely contacts the bottom surface 124*a* of the housing chamber 124. The engaging pieces 125*b* and 125*c* extend along the Y-axis direction. A gap is provided between the engaging pieces 125*b* and 125*c* and the bottom surface 124*a* of the housing chamber 124.

An ink supply needle 126 as a liquid supply needle and an air introduction tube 127 as an air lead-in tube protrude from a side surface 124*b* located at the innermost part of each of the housing chambers 124. The ink supply needle 126 is hollow, and is connected to the corresponding ink supply tube 123. When the ink cartridge 118 is correctly housed in the housing chamber 124, the ink supply needle 126 is inserted into the above described ink discharge port 121*a* of the ink cartridge 118 so that the inside of the ink pack 121 communicates with the inside of the ink supply tube 123.

The air introduction tube 127 has flexibility, and is connected to the above described air supply tube, which extends from the pressure pump 119. When the ink cartridge 118 is correctly housed in the housing chamber 124, the above described communication hole of the ink case 120 abuts the downstream end of the air introduction tube 127 so that the gap 122 of the ink cartridge 118 communicates with the inside of the air introduction tube 127. A seal member 127*a* is provided at the downstream end of the air introduction tube 127, and by this seal member 127*a*, air tightness in the connecting portion of the air introduction tube 127 and the ink cartridge 118 is secured.

Figure 16:
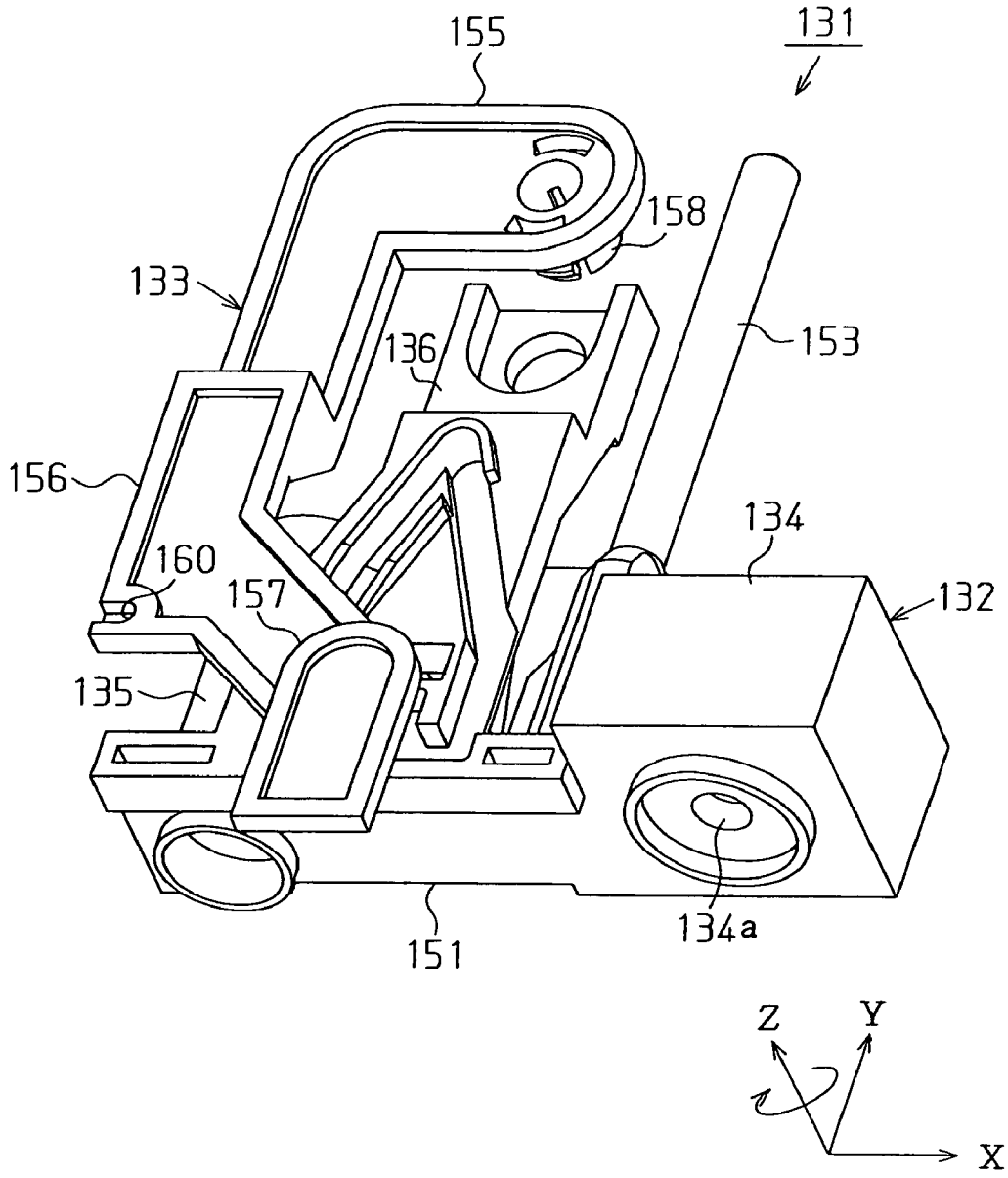
FIG. 16 is a perspective view of a connecting member in the recording apparatus in FIG. 12.

As shown in FIG. 15, a connecting member 131 as shown in FIG. 16 is disposed at the innermost part of the housing chamber 124. The connecting member 131 includes a slide member 132 and a latch claw member 133 as a rotating member.

Figure 17:
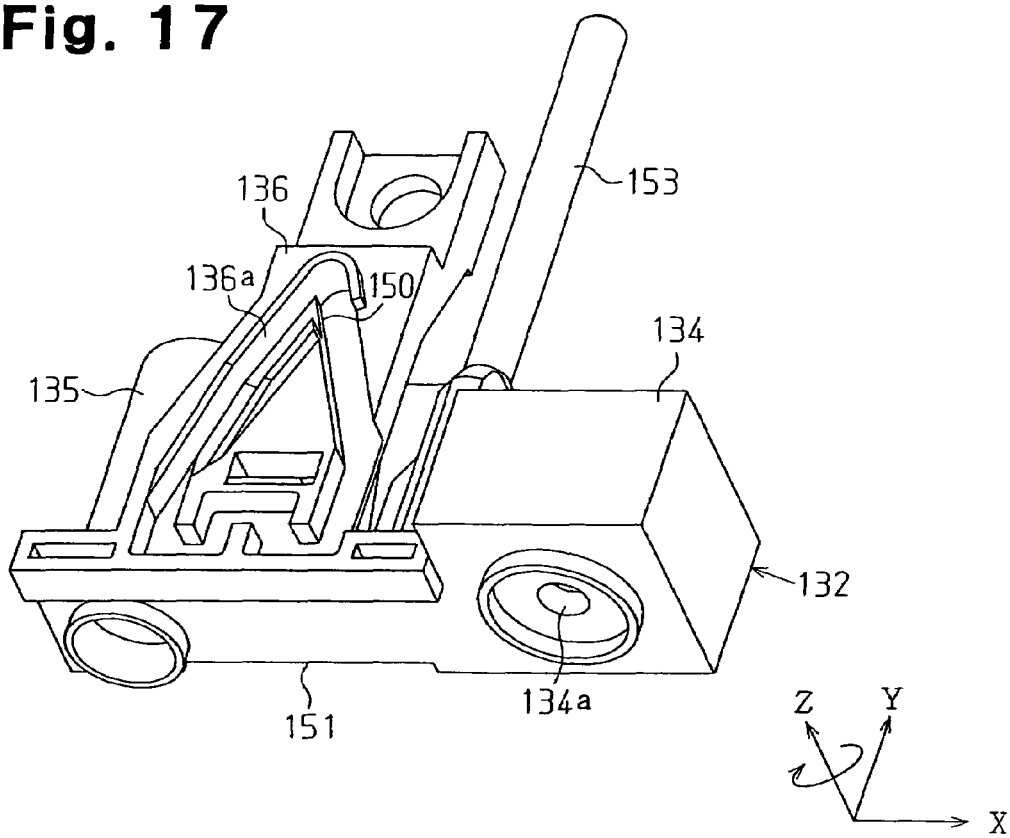
FIG. 17 is a perspective view of a slide member in the recording apparatus in FIG. 12.

As shown in FIG. 16 and FIG. 17, the slide member 132 includes a casing part 134 as liquid absorbing means, a cylindrical part 135 as bending restraining means, and a latch groove part 136. The casing part 134 is the right side part of the slide member 132 in FIG. 17, and has a cavity therein. A needle through-hole 134*a*, which penetrates through the casing part 134 along the Y-axis, is formed in the casing part 134. The above described ink supply needle 126 is movably inserted into the needle through-hole 134*a*. An absorbing material (not shown) constituted of Belleater or the like is housed in the casing part 134 to surround the needle through-hole 134*a*, and the absorbing material absorbs and retains ink leakage from the ink supply needle 126.

The cylindrical part 135 is the left side part of the slide member 132 in FIG. 17, and has a cylindrical shape. As shown in FIG. 15, the air introduction tube 127 projecting from the side surface 124*b* of the above described housing chamber 124 is movably inserted through the cylindrical part 135. The air introduction tube 127 is guided along the Y-axis direction by being inserted into the cylindrical part 135, and is prevented from bending. One end of a first coil spring 137 forming first biasing means abuts the cylindrical part 135 as shown in FIG. 15 and FIG. 20. The other end of the first coil spring 137 abuts the side surface 124*b* of the above described housing chamber 124. The first coil spring 137 biases the cylindrical part 135 in the direction of separation from the side surface 124*b*.

Figure 18:
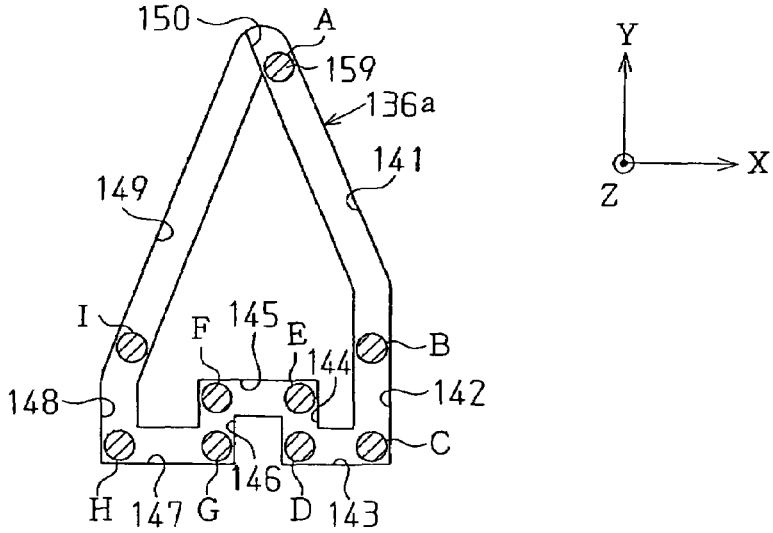
FIG. 18 is a schematic diagram of a latch groove in the recording apparatus in FIG. 12.

The latch groove part 136 is a part of the slide member 132, which is between the casing part 134 and the cylindrical part 135, and a latch groove 136*a* as a guide groove is formed on the top surface of the latch groove part 136. As shown in FIG. 18, the latch groove 136*a* includes nine linear groove portions that are first to ninth grooves 141 to 149. In this embodiment, the first groove 141 is a first groove portion, the fifth groove 145 is a second groove portion, the second to fourth grooves 142 to 144 correspond to a third groove portion, and the sixth to ninth grooves 146 to 149 correspond to a fourth groove portion.

The first groove 141 extends diagonally with respect to the Y-axis. The terminal end of the first groove 141 is located nearer to the casing part 134 than the starting end of the first groove 141 (right side in FIG. 18) and at a front side (lower side in FIG. 18).

The second groove 142 extends in parallel with the Y-axis. The starting end of the second groove 142 connects to the terminal end of the first groove 141. The terminal end of the second groove 142 is located at the front side from the starting end of the second groove 142 (lower side in FIG. 18).

The third groove 143 extends in parallel with the X-axis. The starting end of the third groove 143 connects to the terminal end of the second groove 142. The terminal end of the third groove 143 is located nearer to the cylindrical part 135 (left side in FIG. 18) than the starting end of the third groove 143.

The fourth groove 144 extends in parallel with the Y-axis. The starting end of the fourth groove 144 connects to the terminal end of the third groove 143. The terminal end of the fourth groove 144 is located at the back side (upper side in FIG. 18) from the starting end of the fourth groove 144.

The fifth groove 145 extends in parallel with the X-axis. The starting end of the fifth groove 145 connects to the terminal end of the fourth groove 144. The terminal end of the fifth groove 145 is located nearer to (left side in FIG. 18) the cylindrical part 135 than the starting end of the fifth groove 145.

The sixth groove 146 extends in parallel with the Y-axis. The starting end of the sixth groove 146 connects to the terminal end of the fifth groove 145. The terminal end of the sixth groove 146 is located at the front side (lower side in FIG. 18) from the starting end of the sixth groove 146.

The seventh groove 147 extends in parallel with the X-axis. The starting end of the seventh groove 147 connects to the terminal end of the sixth groove 146. The terminal end of the seventh groove 147 is located nearer to (left side in FIG. 18) the cylindrical part 135 than the starting end of the seventh groove 147.

The eighth groove 148 extends in parallel with the Y-axis. The starting end of the eighth groove 148 connects to the terminal end of the seventh groove 147. The terminal end of the eighth groove 148 is located at the back side (upper side in FIG. 18) from the starting end of the eighth groove 148.

The ninth groove 149 extends diagonally with respect to the Y-axis. The starting end of the ninth groove 149 connects to the terminal end of the eighth groove 148. The terminal end of the ninth groove 149 is located nearer to the casing part 134 (right side in FIG. 18) than the starting end of the ninth groove 149 and at the back side (upper side in FIG. 18), and connects to the starting end of the first groove 141.

The widths of the first to ninth grooves 141 to 149 are substantially the same as each other. The depths of the first to eighth grooves 141 to 148 are substantially the same as each other. The depth of the ninth groove 149 at the starting end is substantially the same as the depths of the first to eighth grooves, and the depth of the ninth groove 149 becomes gradually shallower toward the terminal end from the starting end. Accordingly, a step 150 is formed in a border of the starting end of the first groove 141 and the terminal end of the ninth groove 149.

As shown in FIG. 17, a slide groove 151 extending in parallel with the Y-axis is provided at the undersurface of the slide member 132. The above described rail member 125 is fitted in the slide groove 151, and both side surfaces of the slide groove 151 are engaged with the engaging pieces 125*b* and 125*c* of the above described rail member 125 shown in FIG. 15. As a result, the slide member 132 is slidable along the rail member 125.

As shown in FIG. 17, the slide member 132 includes a rod member 153, which projects in the Y-axis direction. A tip end of the rod member 153 is inserted in and supported by the through-hole (not shown) formed in the side surface 124*b*, and is movable along the Y-axis direction. As shown in FIG. 15, a second coil spring 154 forming first biasing means is fitted over the rod member 153. One end of the second coil spring 154 abuts a slide member 132, and the other end of the second coil spring 154 abuts the side surface 124*b* at the innermost part of the housing chamber 124. The slide member 132 is biased to separate from the side surface 124*b* of the housing chamber 124 (see FIG. 15) by the second coil spring 154 and the above described first coil spring 137.

The latch claw member 133 includes a first support member 155, as shown in FIG. 16 and FIG. 20, a second support member 156 integrally provided at the first support member 155, and a third support member 157 integrally provided at the second support member 156. Each of the first support member 155, the second support member 156 and the third support member 157 is formed into a flat shape.

A cylindrical shaft portion 158 projecting in the opposite direction from the arrow Z, namely, downward is formed at one end of the first support member 155. This cylindrical shaft portion 158 is rotatably supported at a bearing member, not shown, provided at the above described housing chamber 124 as shown in FIG. 20. Accordingly, the latch claw member 133 is supported by the bearing member, not shown, so as to be able to normally rotate in the arrow direction around the Z-axis with the shaft portion 158 as the center of rotation and to be able to reversely rotate in the opposite direction from the arrow direction.

As shown in FIG. 19, the second support member 156 formed to extend from the tip end portion of the first support member 155 has a first claw member 159 in a columnar shape at the undersurface of its tip end portion. The first claw member 159 corresponds to a claw member. The first claw member 159 is fitted in the latch groove 136*a* of the above described slide member 132, and moves inside the latch groove 136*a*. When the first claw member 159 moves inside the latch groove 136*a*, the shaft portion 158 rotates with the movement of the first claw member 159, and is capable of moving slightly along the Z-axis direction. As a result, the first claw member 159 moves inside the latch groove 136*a*, and the second claw member 162 is positioned on the groove 163. As shown in FIG. 20, a locking hole 160 is formed in a tip end of the second support member 156 at the side of the side surface 124*c*. A third coil spring 161 as second biasing means is laid between the locking hole 160 and a hole formed in the side surface 124*c* (not shown). The latch claw member 133 is biased toward the side surface 124*c* by the third coil spring 161.

When the slide member 132 is disposed at the position spaced from the side surface 124*b* by the first and second coil springs 137 and 154, the first claw member 159 of the latch claw member 133 is disposed at a position A (starting end) as shown in FIG. 18. The position of the slide member 132 at this time shall be called an extraction allowing position as a first position (first slide position).

When the slide member 132 moves by being pressed to the back side against the elastic force of the first and second coil springs 137 and 154, the first claw member 159 moves in the first groove 141 from the starting end to the terminal end, and further moves from the starting end of the second groove 142 to the terminal end (position C shown in FIG. 18). The first claw member 159 disposed at position A does not move into the ninth groove 149 from position A because the step 150 exists between the first groove 141 and the ninth groove 149.

When the first claw member 159 reaches the terminal end (position C) of the second groove 142, the latch claw member 133 moves the first claw member 159 from the starting end to the terminal end (position D) by the elastic force of the third coil spring 161. When the pressing force applied to the slide member 132 is released in this state, the slide member 132 moves in the direction of separation from the side surface 124*b* by the elastic forces of the first and second coil springs 137 and 154. At this time, the first claw member 159 moves to the terminal end (position E) of the fourth groove 144 from position D. When the first claw member 159 reaches the terminal end of the fourth groove 144 (position E), the latch claw member 133 moves the first claw member 159 in the fifth groove 145 from the starting end to the terminal end (position F) by the elastic force of the third coil spring 161.

When the slide member 132 is moved by being pressed to the back side against the elastic forces of the first and second coil springs 137 and 154, the first claw member 159 moves from position F to the terminal end (position G) of the sixth groove 146. When the first claw member 159 reaches the terminal end (position F) of the sixth groove 146, the latch claw member 133 moves the first claw member 159 in the seventh groove 147 from the starting end to the terminal end (position H) by the elastic force of the third coil spring 161.

When the first claw member 159 reaches position H, and releases the pressing force applied to the slide member 132, the slide member 132 moves in the direction of separation from the side surface 124*b* by the elastic forces of the first and second coil springs 137 and 154. Namely, the first claw member 159 moves in the eighth groove 148 and the ninth groove 149 and returns to the starting end (position A) of the first groove 141.

Accordingly, when the slide member 132 is operated to be pressed toward the side surface 124*b* twice, the first claw member 159 goes round the latch groove 136*a* and returns to position A. Namely, the first claw member 159 is guided from position A to position F by the first pressing operation, and is guided from position F to position A by the second pressing operation.

The third support member 157, which is formed to extend at a tip end portion of the second support member 156, has the second claw member 162 in the columnar shape as an engaging member formed to project at the undersurface of the tip end portion. The second claw member 162 is designed to be fitted in the groove 163 formed in the ink case 120 of the above described ink cartridge 118. In this embodiment, the groove 163, which guides the second claw member 162, is formed to be larger than the movement route enveloping the part from position H to position I of the latch groove 136*a* in which the first claw member 159 is engaged, in proportion to the distance from the shaft portion 158 of the latch claw member 133.

Namely, when the ink cartridge 118 is applied and pressed to the slide member 132 in order to attach the ink cartridge 118 to the cartridge holder 113, the first claw member 159 moves in the first groove 141 and moves to position B inside the second groove 142. The second claw member 162 moves with the first claw member 159 and displaces in the opposite direction from the arrow Y direction, and opposes a first guide groove 166 of the groove 163 formed in the ink case 120. Accordingly, when the first claw member 159 moves from position B to position C in the second groove 142, the second claw member 162 is guided to position K in the first guide groove 166 as shown in FIG. 21. The position of the slide member 132 shall be called a mounting position as a second position (second slide position).

When the first claw member 159 moves from position C of the second groove 142 to position D of the third groove 143, the second claw member 162 is guided from position K to position L in a second guide groove 167 as shown in FIG. 21. When the first claw member 159 moves from position D to position E of the fourth groove 144, the second claw member 162 is guided from position L to position M in the second guide groove 167 as shown in FIG. 21. When the first claw member 159 moves from position E to position F in the fifth groove 145, the second claw member 162 is guided from position M to position N in the second guide groove 167 as shown in FIG. 21.

At this point in time, the ink cartridge 118 is in the state in which it is attached to the cartridge holder 113. If the ink cartridge 118 is to be extracted in this state, the ink cartridge 118 cannot be removed from the cartridge holder 113 because the first claw member 159 is engaged with the side surface of the fifth groove 145 and the second claw member 162 is engaged with the locking portion 164.

When the slide member 132 is subsequently pressed via the ink cartridge 118, the first claw member 159 moves to position F, position G, position H, position I and position A in this order as described above. At this time, the second claw member 162 is guided to position N, position O and position P in this order, and to position Q of a third guide groove 168 as described in FIG. 21. As a result, the second claw member 162 is removed from the locking portion 164, and is extracted from the groove 163 formed in the ink case 120. Accordingly, the ink cartridge 118 can be removed from the cartridge holder 113.

Next, concerning the printer 111 constructed as described above, operation when the ink cartridge 118 is attached and detached will be explained.

In the state in which the ink cartridge 118 is not mounted in the housing chamber 124 of the printer 111, the slide member 132 is located at the extraction allowing position as shown in FIG. 19 and FIG. 20. In this state, the user slides a new ink cartridge 118 into the housing chamber 124 of the cartridge holder 113 in the Y-axis direction, and thereby, the side surface 118*b* of the ink cartridge 118 abuts the slide member 132. At this time, the second claw member 162 is not located at the upper surface 120*a* of the ink cartridge 118, and is in the state incapable of engaging with the locking portion 164 of the ink cartridge 118.

When the user further presses the ink cartridge 118 in the arrow Y direction, the slide member 132 moves in the arrow Y direction against the biasing force of the first coil spring 137 and the second coil spring 154. Then, the first claw member 159 of the latch claw member 133 moves along the first groove 141 and the second groove 142 of the latch groove 136*a* and guides the second claw member 162 from position J of the groove 163 to position K. The first claw member 159 is located at the terminal end of the second groove 142, namely, position C. When the first claw member 159 moves along the first groove 141 and the second groove 142, the ink supply needle 126 penetrates through the needle through-hole 134*a* provided in the casing part 134 to be inserted into the ink discharge port 121*a* of the ink cartridge 118. The air introduction tube 127 is supported in the cylindrical part 135 of the slide member 132 in a state in which it is prevented from bending so as to be connected to the communication hole of the ink cartridge 118. Accordingly, accuracy at the time of connection of the communication hole of the ink cartridge 118 and the air introduction tube 127 can be enhanced.

When the first claw member 159 is located at position C, the latch claw member 133 rotates in the direction of the arrow around the Z-axis with the shaft portion 158 as the center of rotation by the biasing force of the third coil spring 161, and the first claw member 159 moves along the third groove 143 of the latch groove 136*a*. As a result, the first claw member 159 is located at the terminal end of the third groove 143, namely, at position D. The first claw member 159 guides the second claw member 162 to position L.

Figure 22:
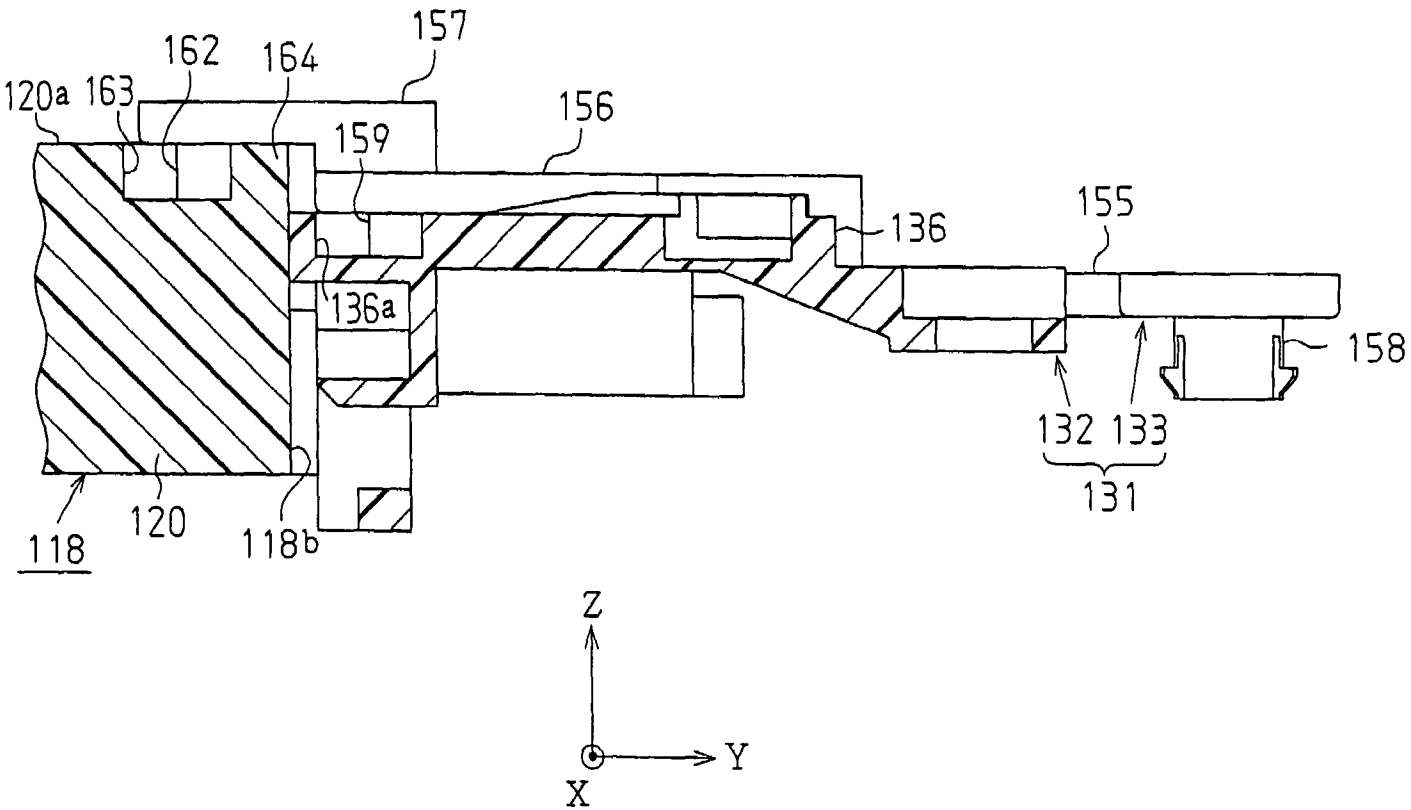
FIG. 22 is a sectional view of the connecting member in the recording apparatus in FIG. 12.
Figure 23:
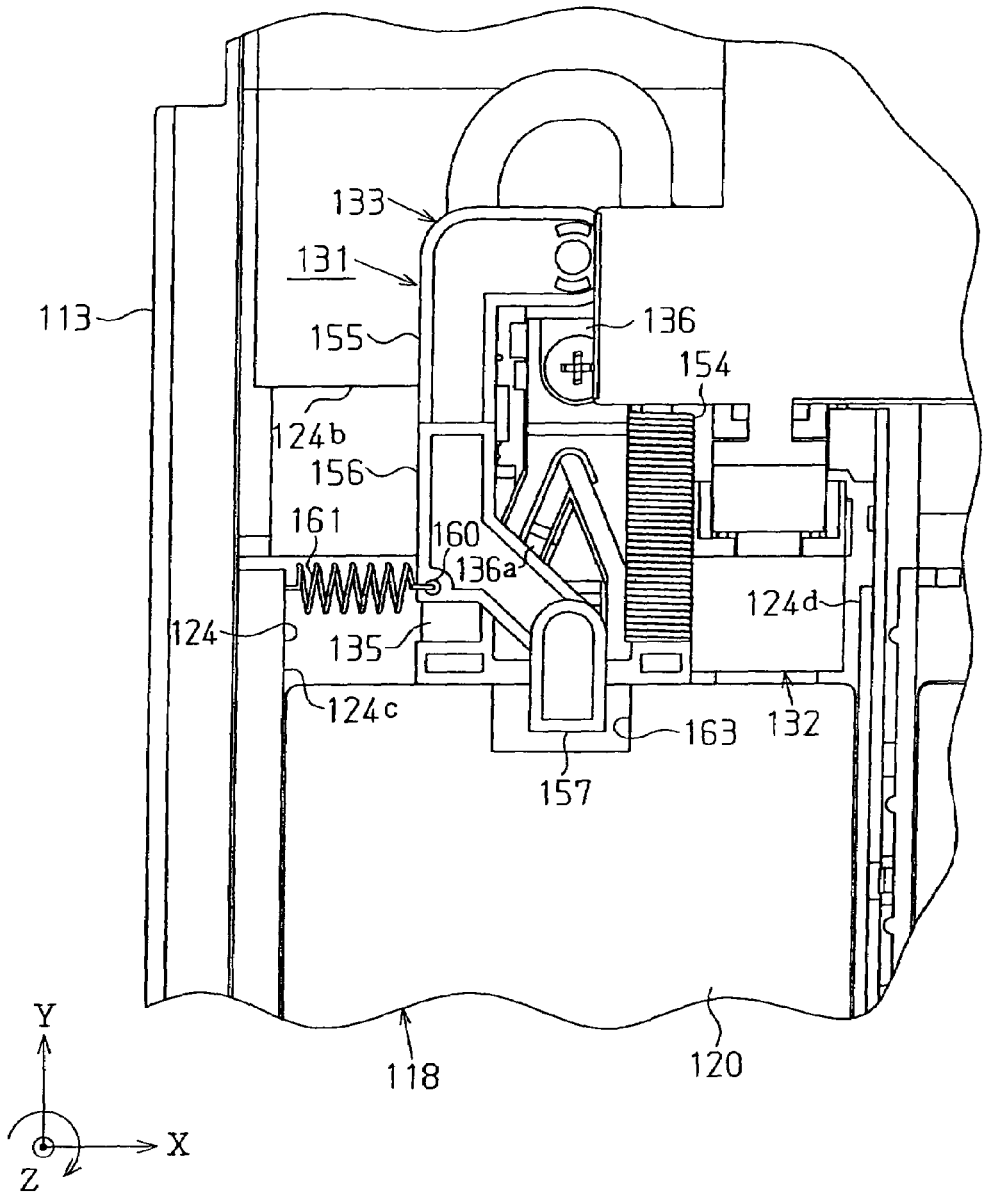
FIG. 23 is a partial plan view of the cartridge holder in the recording apparatus in FIG. 12.

When the user stops pressing the ink cartridge 118 in this state, the slide member 132 is moved in the direction of separation from the side surface 124*b* by the biasing force of the first coil spring 137 and the second coil spring 154. As a result, the latch claw member 133 moves along the fourth groove 144, and is located at the terminal end of the fourth groove 144, namely, position E. Then, the latch claw member 133 is moved in the direction toward the side surface 124*c* by the biasing force of the third coil spring 161, and therefore, rotates in the direction of the arrow around the Z-axis with the shaft portion 158 as the center of rotation, and the first claw member 159 moves along the fifth groove 145 of the latch groove 136*a*. As a result, the first claw member 159 is located at the terminal end of the fifth groove 145, namely, position F. When the first claw member 159 is located at position F, the slide member 132 is located at the mounting position as shown in FIG. 22 and FIG. 23, and the second claw member 162 is locked at the locking portion 164. As a result, movement of the ink cartridge 118 in the direction along the Y-axis is restrained. Since the second claw member 162 moves while being locked at the groove 163, the upper surface of the locking portion 164 is locked at the third support member 157. Therefore, movement of the ink cartridge 118 in the direction along the Z-axis is restrained.

Namely, when the ink cartridge 118 is housed in the cartridge holder 113, the user only has to stop pressing after sliding the ink cartridge 118 into the housing chamber 124 and pressing it to the back once. By doing so, the ink cartridge 118 is easily housed in the cartridge holder 113. When the ink cartridge 118 is fixed to the cartridge holder 113, the ink cartridge 118 is fixed to the slide member 132 while keeping the state in which the second claw member 162 is guided into the groove 163 on the ink cartridge 118.

When the ink cartridge 118 is housed in the cartridge holder 113, the movement of the ink cartridge 118 in the X-axis direction is restrained by the side surface 124*c* and the side surface 124*d* of the housing chamber 124, and further restrained by the second claw member 162 guided by the latch claw member 133. As a result, the latch claw member 133 is locked at the upper surface 120*a* of the ink cartridge 118, and movement in the Z-axis direction of the ink cartridge 118 is also restrained. Therefore, when the ink cartridge 118 is in the state in which it is housed in the cartridge holder 113, the ink cartridge 118 is fixed in a state in which it is guided into the cartridge holder 113 and does not swing. Therefore, even if vibration and drop occur at the time of transportation and printing, ink leakage and air leakage hardly occur.

When the ink cartridge 118 housed in the housing chamber 124 is removed, the user presses the ink cartridge 118 in the arrow Y direction. Then, the slide member 132 moves in the arrow Y direction against the biasing forces of the first coil spring 137 and the second coil spring 154. Then, the first claw member 159 of the latch claw member 133 moves along the sixth groove 146 of the latch groove 136*a* as shown in FIG. 18, and is located at the terminal end of the sixth groove 146, namely, position G.

When the first claw member 159 is located at position G, the second support member 156 is biased in the direction toward the side surface 124*c* by the biasing force of the third coil spring 161. Therefore, the latch claw member 133 rotates in the direction of the arrow around the Z-axis with the shaft portion 158 as the center of rotation, and the second claw member 162 moves along the seventh groove 147 of the latch groove 136*a*. As a result, the first claw member 159 is located at the terminal end of the seventh groove 147, namely, position H.

When the user stops pressing the ink cartridge 118 in this state, the slide member 132 is moved in the direction of separation from the side surface 124*b* by the biasing forces of the first coil spring 137 and the second coil spring 154. The latch claw member 133 inversely rotates in the direction of the arrow around the Z-axis with the shaft portion 158 as the center of rotation. As a result, the first claw member 159 moves along the eighth groove 148 and the ninth groove 149, and moves to the terminal end of the ninth groove 149. Then, the first claw member 159 passes over the step 150 and drops, and is located at position A. The first claw member 159 guides the second claw member 162 to position Q from position P to locate it above the latch groove 136*a* again. When the first claw member 159 moves along the ninth groove 149 from the eighth groove 148, the ink supply needle 126 is extracted from the ink discharge port 121*a* of the ink cartridge 118. At this time, ink leakage from the ink supply needle 126 is absorbed by the absorbing material inside the casing part 134. Accordingly, the inside of the housing chamber 124 is kept clean.

As a result, the slide member 132 is located at the extraction allowing position as shown in FIG. 19 and FIG. 20. Namely, the second claw member 162 is in a state in which it is not locked at the locking portion 164 of the ink cartridge 118. Accordingly, the user can easily extract the ink cartridge 118 from the cartridge holder 113 by only grasping and slightly pulling the ink cartridge 118.

The second embodiment has the following advantages.

(1) In this embodiment, when the slide member 132 is located at the extraction allowing position, the user can attach and detach the ink cartridge 118 by pressing the ink cartridge 118 in the arrow Y direction.

When the slide member 132 is located at the mounting position, the ink cartridge 118 is fixed to the cartridge holder 113 by engagement of the locking portion 164 of the ink cartridge 118 and the second claw member 162 of the latch claw member 133. At this time, movement of the ink cartridge 118 in the X-axis direction is restrained by the second claw member 162 guided by the latch claw member 133 in addition to the side surfaces 124*c* and 124*d* of the housing chamber 124. Since the second claw member 162 moves while being locked at the groove 163 in the upper surface 120*a* of the ink cartridge 118, and therefore, the ink cartridge 118 is restrained in movement in the direction along the Z-axis by the third support member 157. Namely, the ink cartridge 118 is fixed to the cartridge holder 113 in a state in which it is guided thereto. Therefore, the ink cartridge 118 does not swing with respect to the cartridge holder 113. Accordingly, ink is effectively prevented from leaking out of the connecting portions or the like of the ink cartridge 118 and the ink supply needle 126 even if vibration and drop occur at the time of transportation and printing.

(2) In this embodiment, the slide member 132 is biased in the direction of separation from the side surface 124*b* of the housing chamber 124 by the first coil spring 137 and the second coil spring 154. The slide member 132 is also biased to the side surface 124*c* of the housing chamber 124 by the third coil spring 161. In addition, the slide member 132 is fixed at the mounting position by engagement of the latch groove 136*a* and the first claw member 159, and engagement of the groove 163 and the second claw member 162.

Accordingly, when the slide member 132 is moved to the mounting position from the extraction allowing position, it is suitable to slide the slide member 132 against the biasing forces of the first coil spring 137 and the second coil spring 154 and locate the slide member 132 at the mounting position. The slide member 132 when located at the mounting position is kept at the mounting position by the locking portion 164 and the second claw member 162. On the other hand, when the slide member 132 is moved to the extraction allowing position from the mounting position, the slide member 132 naturally moves to the extraction allowing position by the biasing force of the biasing means by releasing engagement of the locking portion 164 and the second claw member 162.

Namely, when the slide member 132 is displaced to the extraction allowing position or the mounting position, the slide member 132 only has to be pressed in the insertion direction of the ink cartridge 118. Accordingly, switching of the position of the slide member 132 is extremely easy.

(3) In this embodiment, the slide member 132 is provided with the latch groove 136*a*, and the slide groove 151 is provided at the undersurface of the slide member 132. Therefore, the position of the slide member 132 is determined by the engagement of the slide groove 151 and the rail member 125, and the engagement position of the latch groove 136*a* and the first claw member 159 of the latch claw member 133. Accordingly, movement of the slide member 132 is stabilized and movement accuracy of the slide member 132 is enhanced.

(4) In this embodiment, when the slide member 132 is located at the mounting position, the first claw member 159 guides the second claw member 162 to position N, and allows the second claw member 162 to be locked at the locking portion 164. In this state, when the slide member 132 is moved in the insertion direction of the ink cartridge 118, the second claw member 162 is removed from the locking portion 164, and is extracted from the groove 163 formed in the ink case 120. As a result, the ink cartridge 118 is brought into a state in which it can be removed from the cartridge holder 113.

Accordingly, in order to change the position of the slide member 132 between the extraction allowing position and the mounting position, the slide member 132 only has to be pressed in the insertion direction of the ink cartridge 118, namely, in the arrow Y direction. Accordingly, switching of the position of the slide member 132 is extremely easy.

(5) In this embodiment, the groove 163 is provided on the upper surface 120*a* of the ink cartridge 118. The second claw member 162 is locked at the locking portion 164 surrounded by the groove 163, whereby the ink cartridge 118 is fixed at the mounting position. Accordingly, with just the minimal design change of only providing the groove 163, the specification for the existing ink cartridge can be changed to a specification that is engageable with the second claw member 162.

(6) In this embodiment, the slide member 132 is provided with the casing part 134 having the needle through-hole 134*a*, and the absorbing material is housed inside of the casing part 134. Accordingly, ink leakage out of the ink supply needle 126 when the ink cartridge 118 is extracted from the housing chamber 124 is absorbed by the absorbing material inside the casing part 134. Accordingly, the inside of the housing chamber 124 is kept clean.

(7) In this embodiment, the slide member 132 is provided with the cylindrical part 135, and by the cylindrical part 135, bending of the air introduction tube 127 is prevented. Accordingly, when the ink cartridge 118 is housed in the housing chamber 124, the air introduction tube 127 is positioned by the cylindrical part 135 integrated with the slide member 132 with the movement of the slide member 132. Accordingly, connection accuracy of the communication hole of the ink cartridge 118 and the air introduction tube 127 is enhanced.

(8) In this embodiment, the latch claw member 133 is constructed by the first support member 155, the second support member 156 and the third support member 157, which are integrally formed. Therefore, a shift due to assembly does not occur between the first claw member 159 of the second support member 156 and the second claw member 162 of the third support member 157. Therefore, movement of the first claw member 159 following rotation of the latch claw member 133 is transmitted to the second claw member 162 with high accuracy. Accordingly, positioning accuracy of the ink cartridge 118 with respect to the slide member 132 and the cartridge holder 113 is enhanced. Since the latch claw member 133 is constructed by integral formation, the number of components can be restrained to the minimum.

(9) Both end portions of the groove 163 provided on the upper surface 120*a* of the ink cartridge 118 extend along the Y-axis direction and are opened at one side of the ink cartridge 118. Therefore, the second claw member 162 is not disengaged from the groove 163 in the direction other than the Y-axis direction.

The second embodiment may be changed as follows.

In the above described embodiment, the groove 163 and the locking portion 164 may be provided at the side surface and the bottom surface of the ink cartridge 118 instead of the upper surface 120*a* of the ink cartridge 118. In this case, the first claw member 159 and the second claw member 162 may be provided at the latch claw member 133 so as to oppose the groove 163 and the locking portion 164.

In the above described embodiment, a total of three coil springs, which are the first coil spring 137, the second coil spring 154 and the third coil spring 161, are used as the biasing means, but the number of coil springs that are used is not limited to this. The biasing means may not be a coil spring, but may be a plate spring or rubber.

In the above described embodiment, the fixing means for keeping the slide member 132 in the mounting position is formed by the latch groove 136*a* and the first claw member 159, the second claw member 162 and the locking portion 164. This fixing means may be changed to the other fixing means only if it fixes the slide member 132 in the mounting position and is switchable to allow movement to the extraction allowing position from the mounting position in accordance with necessity. For example, the projected first claw member 159 is formed at the slide member 132, the projected second claw member 162 is formed on the ink cartridge 118, and the groove 163 fitted on the first claw member, and the locking portion 164 at which the second claw member 162 is locked may be formed on the latch claw member 133.

In the above described embodiment, the shape of the locking portion 164 may be changed. For example, a recessed portion which is recessed in the arrow Y direction and a V-shaped groove may be provided at the locking portion so that when the first claw member 159 is engaged with F position, the second claw member 162 is guided to the locking portion 164. Alternatively, the projected portion which project in the opposite direction from the arrow Y direction may be formed. As a result, the first claw member 159 is engaged with position F at the same time as when the second claw member 162 is locked at the projected portion and the locking portion 164, and therefore, movement in the direction along the X-axis and the Y-axis is restrained.

In the above described embodiment, the slide member 132 includes the casing part 134 and the cylindrical part 135, but the slide member 132 may not include the casing part 134 or/and the cylindrical part 135.

In the above described embodiment, the ink cartridge 118 is formed by the ink pack 121 as the liquid housing portion, and the ink case 120 as the liquid case, but the liquid housing portion and the liquid case are not limited to this. For example, the liquid housing portion and a gap may be formed by partitioning the inside of the ink case 120 by a film or the like.

In the above described embodiment, the printer 111 transfers the ink inside the ink pack 121 into the recording head 116 by introducing air into the gap 122 between the ink case 120 and the ink pack 121 by the pressure pump 119. Instead of this, the position of the ink pack 121 is located above the recording head 116, and thereby, the ink inside the ink pack 121 may be transferred to the recording head 116 by gravity. In this case, it is not necessary to provide the cylindrical part 135 at the slide member 132.

The present invention may be embodied in an ink jet recording apparatus other than the printer 111 in FIG. 12, for example, in printing apparatuses such as a fax and a copier. Alternatively, the present invention may be embodied in a liquid ejection apparatus which ejects liquid other than ink. The liquid ejection apparatus, which ejects liquid other than ink, may be a liquid ejection apparatus that injects liquid, such as an electrode material and a coloring material, which are used for manufacturing a liquid crystal display, an EL display and a surface emitting display, a liquid ejection apparatus for ejecting biological organic matter used for manufacturing biochips, or a specimen ejection apparatus as a precision pipette.

The invention claimed is:

1. A liquid ejection apparatus comprising:

a cartridge holder;

a liquid cartridge detachably mounted on the cartridge holder and storing liquid, the liquid in the liquid cartridge attached to the cartridge holder being ejected toward a target;

a slide member and a rotating member, wherein:

said slide member is slidably supported at said cartridge holder, the slide member slides along an insertion direction of the liquid cartridge between a first position and a second position, and the insertion direction is a direction in which the liquid cartridge is inserted into the cartridge holder when the liquid cartridge is attached to the cartridge holder, and said rotating member is rotatably supported at said cartridge holder, rotation of the rotating member is linked to sliding of said slide member, and when the slide member moves to the second position from the first position, the rotating member displaces so as not to allow removal of the liquid cartridge from the cartridge holder, and when the slide member moves to the first position from the second position, the rotating member displaces to allow removal of the liquid cartridge from the cartridge holder; and a liquid supply needle connected to said liquid cartridge, wherein the liquid supply needle is movably inserted through said slide member, and said slide member includes liquid absorbing means integrated with the slide member to surround the liquid supply needle and to absorb liquid leakage.

2. A liquid ejection apparatus comprising a liquid ejection head for ejecting liquid toward a target;

a liquid cartridge for storing said liquid;

a liquid passage for connecting said liquid ejection head and said liquid cartridge;

a cartridge holder for housing said liquid cartridge; and a slide member and a rotating member, wherein:

said slide member is slidably supported at said cartridge holder, the slide member is slidable along an insertion direction of said liquid cartridge between a first position and a second position, and the insertion direction is a direction in which the liquid cartridge is inserted into the cartridge holder when the liquid cartridge is attached to the cartridge holder, and said rotating member is rotatably supported at said cartridge holder, rotation of the rotating member is linked to sliding of said slide member, and when said slide member moves to the second position from the first position, the rotating member displaces so as to connect said liquid cartridge to said slide member, and when said slide member moves to the first position from the second position, the rotating member displaces to release connection of said liquid cartridge to said slide member, wherein said liquid passage includes a liquid supply needle connected to said liquid cartridge, said liquid supply needle is movably inserted through said slide member, and said slide member includes liquid absorbing means integrated with the slide member to surround said liquid supply needle and to absorb liquid leakage.

3. The liquid ejection apparatus according to claim 2, further comprising biasing means for biasing said slide member to said first position from said second position, in which movement of the slide member from the first position to the second position is performed against the biasing force of said biasing means, and wherein said rotating member includes an engaging member which switches between a state in which the engaging member engages with said liquid cartridge and a state in which the engaging member does not engage with said liquid cartridge in accordance with rotation of the rotating member.

4. The liquid ejection apparatus according to claim 3, wherein said slide member includes a guide groove, said rotating member includes a claw member movable inside the guide groove along said guide groove, in which rotation of the rotating member is linked to movement of the claw member, and said guide groove includes a first groove portion in which said claw member engages when said slide member is located at said first position, a second groove portion in which said claw member engages when said slide member is located at said second position, with movement of said slide member to said first position being restrained when said claw member engages in the second groove portion, a third groove portion which guides said claw member from said first groove portion to said second groove portion when said slide member moves from said first position to said second position, and a fourth groove portion which guides said claw member from said second groove portion to said first groove portion when said slide member moves from said second position to said first position.

5. The liquid ejection apparatus according to claim 4, wherein said fourth groove portion is formed to guide said claw member from said second groove portion to said first groove portion when said slide member slides in an insertion direction of said liquid cartridge from said second position.

6. The liquid ejection apparatus according to claim 3, wherein the engaging member, which is included by said rotating member, engages in a groove open at one side of an upper surface of said liquid cartridge, and connects said liquid cartridge and said slide member.

7. The liquid ejection apparatus according to claim 3, wherein said biasing means is first biasing means, the liquid ejection apparatus further comprises second biasing means for biasing said rotating member in one direction, and said rotating member rotates against biasing force of said second biasing means during movement of the slide member from the first position to the second position, and rotates while being biased by said second biasing means during movement of the slide member to the first position from the second position.

8. The liquid ejection apparatus according to claim 2, wherein said liquid cartridge includes a communication hole, said cartridge holder includes an air lead-in tube connected to said communication hole of the liquid cartridge housed in the cartridge holder, and said slide member includes bending restraining means integrated with the slide member to restrain bending of the air lead-in tube.

* * * * *